US008760374B2

(12) United States Patent
Osame et al.

(10) Patent No.: US 8,760,374 B2
(45) Date of Patent: Jun. 24, 2014

(54) DISPLAY DEVICE HAVING A LIGHT EMITTING ELEMENT

(75) Inventors: Mitsuaki Osame, Kanagawa (JP); Aya Anzai, Kanagawa (JP); Yu Yamazaki, Tokyo (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 994 days.

(21) Appl. No.: 11/121,587

(22) Filed: May 4, 2005

(65) Prior Publication Data

US 2005/0259093 A1 Nov. 24, 2005

(30) Foreign Application Priority Data

May 21, 2004 (JP) ..... 2004-152543

(51) Int. Cl.
*G09G 3/32* (2006.01)

(52) U.S. Cl.
USPC ..... 345/82

(58) Field of Classification Search
CPC ..... G09G 3/3225
USPC ..... 345/76–83; 315/169.3
See application file for complete search history.

(56) References Cited

U.S. PATENT DOCUMENTS

| | | | | |
|---|---|---|---|---|
| 6,525,704 | B1 * | 2/2003 | Kondo et al. | 345/78 |
| 6,618,031 | B1 * | 9/2003 | Bohn et al. | 345/83 |
| 6,740,938 | B2 | 5/2004 | Tsunoda et al. | 257/365 |
| 6,762,552 | B1 | 7/2004 | Duineveld et al. | |
| 7,102,280 | B1 | 9/2006 | Dunineveld et al. | |
| 7,230,591 | B2 | 6/2007 | Inukai | |
| 7,439,673 | B2 | 10/2008 | Dagois et al. | |
| 2001/0011868 | A1 | 8/2001 | Fukunaga et al. | |
| 2002/0042152 | A1 * | 4/2002 | Yamazaki et al. | 438/4 |
| 2002/0047555 | A1 * | 4/2002 | Inukai | 315/169.3 |
| 2002/0113760 | A1 | 8/2002 | Kimura | 345/82 |
| 2002/0149053 | A1 | 10/2002 | Tsunoda et al. | 257/347 |
| 2002/0180671 | A1 | 12/2002 | Inukai | |
| 2003/0103022 | A1 * | 6/2003 | Noguchi et al. | 345/77 |

(Continued)

FOREIGN PATENT DOCUMENTS

| | | | |
|---|---|---|---|
| CN | 1388504 | A | 1/2003 |
| CN | 1417767 | A | 5/2003 |

(Continued)

OTHER PUBLICATIONS

Office Action re Chinese application No. CN 200510079249.7, dated Mar. 1, 2010 (with English translation).

(Continued)

*Primary Examiner* — Claire X Pappas
*Assistant Examiner* — Robert Stone
(74) *Attorney, Agent, or Firm* — Husch Blackwell LLP

(57) ABSTRACT

When a thin film transistor has an LDD structure or a double gate structure, the number of manufacturing steps increases, which may decrease the yield. The invention provides a display device where the influence of off current is reduced by a method different from the conventional one. According to the invention, a pass element is provided at one electrode of a light emitting element so as not to flow the off current of a transistor for driving the light emitting element through the light emitting element in a non-lighting period. The pass element allows the off current to flow outside, that is, the off current can be bypassed outside through the pass element.

7 Claims, 20 Drawing Sheets

(56) References Cited

U.S. PATENT DOCUMENTS

| | | | | |
|---|---|---|---|---|
| 2003/0112205 | A1* | 6/2003 | Yamada | 345/32 |
| 2003/0112208 | A1* | 6/2003 | Okabe et al. | 345/82 |
| 2003/0201960 | A1* | 10/2003 | Fujieda | 345/87 |
| 2003/0214245 | A1* | 11/2003 | Yamazaki et al. | 315/169.3 |
| 2004/0080475 | A1* | 4/2004 | Yoshida | 345/82 |
| 2004/0090186 | A1* | 5/2004 | Yoshida et al. | 315/169.1 |
| 2004/0179005 | A1* | 9/2004 | Jo | 345/211 |
| 2004/0252565 | A1* | 12/2004 | Yamazaki et al. | 365/202 |
| 2004/0257353 | A1* | 12/2004 | Imamura et al. | 345/204 |
| 2004/0263508 | A1* | 12/2004 | Koyama et al. | 345/212 |
| 2004/0263741 | A1* | 12/2004 | Koyama et al. | 349/139 |
| 2005/0017928 | A1* | 1/2005 | Osame et al. | 345/76 |
| 2005/0134189 | A1* | 6/2005 | Osame et al. | 315/169.1 |
| 2005/0195178 | A1* | 9/2005 | Jo et al. | 345/204 |
| 2005/0219170 | A1* | 10/2005 | Seki | 345/77 |
| 2006/0077194 | A1* | 4/2006 | Jeong | 345/204 |
| 2007/0120795 | A1* | 5/2007 | Uchino et al. | 345/92 |

FOREIGN PATENT DOCUMENTS

| | | | |
|---|---|---|---|
| EP | 1 122 800 | A2 | 8/2001 |
| JP | 61-112481 | | 7/1986 |
| JP | 2002-323873 | | 11/2002 |
| JP | 2003-023161 | | 1/2003 |
| JP | 2005-513553 | | 5/2005 |
| WO | WO 01/41229 | A1 | 6/2001 |

OTHER PUBLICATIONS

Search Report re European Application No. EP 03001028.4, dated Apr. 15, 2011.

Office Action re Chinese application No. CN 201010532967.6 , dated Nov. 8, 2011 (with English translation).

* cited by examiner

DISPLAY DEVICE HAVING A LIGHT EMITTING ELEMENT

BACKGROUND OF THE INVENTION

1. Field of the Invention

The present invention relates to a display device capable of displaying accurately, particularly black.

2. Description of the Related Art

In recent years, a display device having a self light emitting element has been actively developed. A thin film transistor is often used in a pixel portion of the display device as a semiconductor element. Light emission of the self light emitting element is controlled by turning on/off the thin film transistor. When the thin film transistor is off, a small current that is called an off current may flow. The self light emitting element emits light even with a small off current, which is easily recognized by the human eye and becomes a problem.

As a conventional method of reducing the off current, an LDD (Lightly Doped Drain) structure is known. In this structure, an LDD region doped with an impurity element at a low concentration is provided between a channel forming region and a source region or a drain region doped with an impurity element at a high concentration.

Also suggested is a so-called double gate structure having conductive films that are formed so as to overlap each other with a channel forming region interposed therebetween (see Patent Document 1). The Patent Document 1 discloses a method of reducing the off current by applying a constant voltage to the conductive film of the bottom layer. [Patent Document 1] Japanese Patent Laid-Open No. 2003-23161

However, when a thin film transistor has the LDD structure or the double gate structure as disclosed in the aforementioned Patent Document and the like, the number of manufacturing steps increases, which may decrease the yield.

SUMMARY OF THE INVENTION

The invention provides a display device where the influence of the off current of a transistor connected to a light emitting element is reduced by a method different from the ones disclosed in the aforementioned Patent Document and the like.

In view of the foregoing, according to the invention, an element (hereinafter referred to as a pass element) is provided at one electrode of a light emitting element so as not to flow an off current from a transistor for driving the light emitting element in a non-lighting period. The pass element allows the off current to flow outside. That is, the off current can be bypassed outside through the pass element.

One mode of the invention is described below.

According to one mode of the invention, a display device has a light emitting element, a transistor for driving the light emitting element, and a pass element connected to the light emitting element and the transistor. The resistance of the pass element is lower than the resistance of the light emitting element that is turned off, and higher than the resistance of the light emitting element that is turned on.

In the display device according to the invention, the pass element is one of or a combination of a resistor, a thin film transistor, and a diode.

According to another mode of the invention, a display device has a light emitting element, a first transistor for driving the light emitting element, and a second transistor functioning as a pass element connected to the light emitting element and the first transistor. The second transistor functioning as a pass element is turned off when the first transistor is turned off and it is further turned off when the light emitting element is turned on.

According to another mode of the invention, a display device has a light emitting element, a first transistor for driving the light emitting element, and a second transistor functioning as a pass element connected to the light emitting element and the first transistor. The second transistor functioning as a pass element is turned off when the first transistor is turned off and it is further turned off when the light emitting element is turned on. The resistance of the second transistor functioning as a pass element is lower than the resistance of the light emitting element that is turned off, and higher than the resistance of the light emitting element that is turned on.

According to another mode of the invention, a display device has a light emitting element, a transistor for driving the light emitting element, and a P-channel transistor functioning as a pass element connected to the light emitting element and the driving transistor. A gate electrode of the P-channel transistor is connected to a power supply line, and one or the other electrode of the P-channel transistor is connected to a counter electrode of the light emitting element.

According to another mode of the invention, a display device has a light emitting element, a transistor for driving the light emitting element, and a P-channel transistor functioning as a pass element connected to the light emitting element and the transistor. A gate electrode of the P-channel transistor is connected to a power supply line, and one or the other electrode of the P-channel transistor is connected to a counter electrode of the light emitting element. The resistance of the P-channel transistor is lower than the resistance of the light emitting element that is turned off, and higher than the resistance of the light emitting element that is turned on.

The pass element thus allows the off current of the driving transistor to be bypassed through the pass element when the light emitting element emit no light. In other words, the pass element prevents the off current from flowing through the light emitting element. As a result, high quality black display can be achieved.

DETAILED DESCRIPTION OF THE INVENTION

Figure 1:
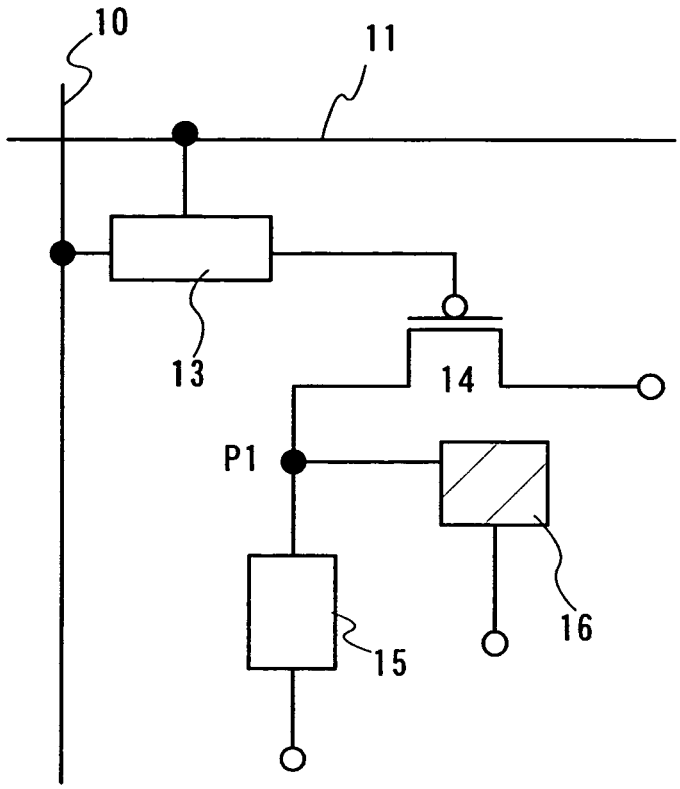
FIG. 1 is a circuit diagram showing a pixel of the invention.

Although the invention will be fully described by way of Embodiment Modes with reference to the accompanying drawings, it is to be understood that various changes and modifications will be apparent to those skilled in the art. Therefore, unless such changes and modifications depart from the scope of the invention, they should be construed as being included therein. Note that in all the drawings for describing Embodiment Modes, the same portion or the portion having the same function is denoted by the same reference numeral, and description thereof is omitted.

A transistor has three terminals of a gate, a source, and a drain. However, the source electrode terminal (source electrode) and the drain electrode terminal (drain electrode) cannot be clearly distinguished because of the structure of the transistor. Therefore, in this specification, the source electrode and the drain electrode are referred to as one electrode or the other electrode.

Embodiment Mode 1

In this embodiment mode, a pixel structure is described with reference to FIG. 1.

A pixel shown in FIG. 1 has a signal line 10, a scan line 11, a switching element 13, a driving transistor 14, a light emitting element 15, and a pass element 16. In this embodiment mode, a P-channel transistor is used as the driving transistor 14.

Connections in such a pixel are described. The switching element 13 is connected to the signal line 10, the scan line 11, the driving transistor 14, and the light emitting element 15 through the driving transistor 14. The pass element 16 is connected to the driving transistor 14 and the light emitting element 15 (P1). That is, the pass element 16 can be referred to as an element connected to the driving transistor 14.

Operation of such a pixel is described. When the switching element 13 is selected by the scan line 11, a video signal is inputted from the signal line 10 to the driving transistor 14 through the switching element 13. Then, the light emitting element 15 emits light or no light depending on the driving transistor 14.

According to such a pixel structure of the invention, the off current of the driving transistor 14 flows through the pass element 16 when the light emitting element 15 emits no light. This is because the resistance of the light emitting element 15 is higher than that of the pass element 16. As a result, there is no risk of the light emitting element 15 emitting light due to the off current of the driving transistor 14.

Meanwhile, when the light emitting element 15 emits light, current should not flow through the pass element 16. If a current flows through the pass element 16, the light emitting element 15 cannot emit light at a predetermined luminance.

Accordingly, the resistance Rp of the pass element 16 is set to satisfy R (off)>Rp>>R (on), and more preferably R (off) >>Rp>>R (on), where R (on) is the resistance of the light emitting element 15 that emits light (that is, the light emitting element 15 is turned on), and R (off) is the resistance of the light emitting element 15 that emits no light (that is, the light emitting element 15 is turned off). It is preferable that R (off)>>Rp>>R (on) be satisfied, in which case most of the off current of the driving transistor 14 can flow through the pass element 16. As a result, a current can flow through the pass element 16 only when the light emitting element 15 emits no light.

In order to obtain the aforementioned resistance, for example, a terminal of the pass element 16 other than P1 may be connected to a counter electrode of the light emitting element 15. This is because the counter electrode of the light emitting element 15 is connected to a low potential power supply.

Figure 2A:
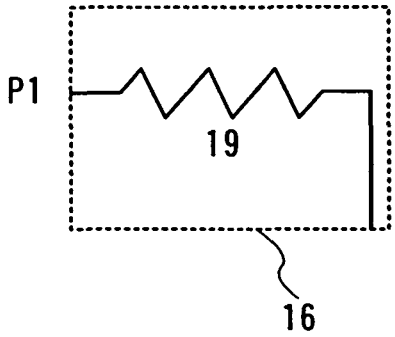
FIGS. 2A to 2D are cross sectional views each showing a pass element of the invention.

FIGS. 2A to 2D show specific examples of the pass element 16. As shown in FIG. 2A, a resistor 19 can be used as the pass element 16.

Figure 2B:
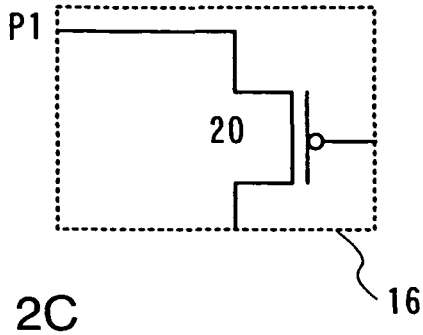

A semiconductor element can also be used as the pass element 16. For example, as shown in FIG. 2B, a P-channel thin film transistor (TFT) 20 can be used as the pass element 16. A gate electrode of the thin film transistor 20 may be connected to a potential that turns off the thin film transistor 20. If the thin film transistor 20 is used, when the light emitting element 15 emits light, the resistance R (TFT) of the thin film transistor 20 satisfies R (TFT)>R (on), and more preferably R (TFT)>>R (on). In other words, it is preferable that the thin film transistor 20 be off when the light emitting element 15 emits light. On the other hand, when the light emitting element 15 emits no light, the resistance R (TFT) satisfies R (off)>R (TFT), and more preferably R (off)>>R (TFT). In other words, it is preferable that the thin film transistor 20 be off when the light emitting element 15 emits no light.

Figure 2C:
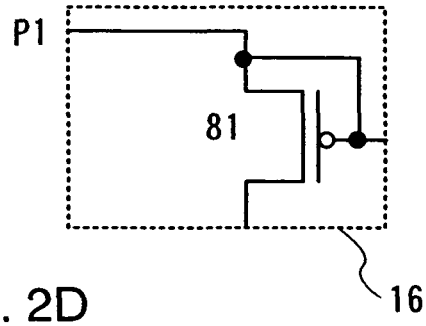
Figure 2D:
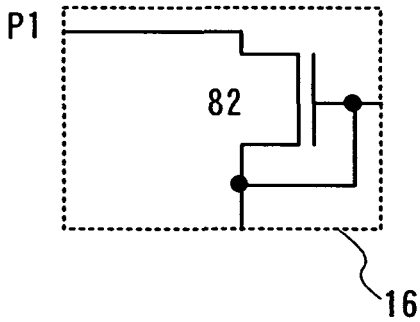

Further, as shown in FIG. 2C, a diode 81 where a gate electrode and a source electrode of a P-channel thin film transistor are connected to each other can be used as the pass element 16. Alternatively, as shown in FIG. 2D, a diode 82 where a gate electrode and a drain electrode of an N-channel thin film transistor are connected to each other can also be used as the pass element 16.

In such resistor 19, thin film transistor 20, and diodes 81 and 82, a terminal other than P1 may be connected to the counter electrode of the light emitting element 15, which is connected to a low potential power supply.

Operation of the thin film transistor 20 shown in FIG. 2B is described. When the light emitting element 15 emits light, a current is supplied from the driving transistor 14. At this time, the thin film transistor 20 of which gate electrode is maintained at a high potential is turned off. That is, the resistance of the thin film transistor 20 is set so as to satisfy Rp>>R (on), and thus no current flows through the thin film transistor 20 that is off.

Meanwhile, when the light emitting element 15 emits no light, one terminal of the thin film transistor 20 other than P1 is connected to the counter electrode of the light emitting element 15, and an off current flows from the driving transistor 14. Then, R (off)>Rp is satisfied and the off current flows through the thin film transistor 20. Accordingly, the off current of the driving transistor 14 does not flow through the light emitting element 15.

In the pixel structure of this embodiment mode, the counter electrode of the light emitting element 15 is connected to a low potential power supply, therefore, the P-channel thin film transistor is used as the pass element 16, However, another pixel structure may also be adopted where the counter electrode of the light emitting element 15 is connected to a high potential power supply. In such a case, an N-channel thin film transistor may be used as the pass element 16 and the driving transistor may have N-type conductivity.

As set forth above, the pass element 16 prevents the off current of the driving transistor from flowing through the light emitting element 15 in a non-lighting period, thereby the display device can perform high quality black display. Particularly when a reverse bias voltage is applied to the light emitting element 15, the off current of the driving transistor does not flow through the light emitting element 15 in a non-lighting period, thereby the display device can perform high quality black display.

When using such a pass element, it is not necessary to manufacture a thin film transistor having a double gate structure or an LDD structure. Accordingly, unnecessary manufacturing steps can be omitted. Note that, the driving transistor may have a double gate structure or an LDD structure if desired.

A pixel structure having such a pass element is not limited to the one shown in this embodiment mode. That is, the pass element can be applied to any pixel structure corresponding to a current input method where a current is inputted as a video signal, a voltage input method where a voltage is inputted as a video signal, a digital driving method where a video signal is inputted as a digital signal, an analog driving method where a video signal is inputted as an analog signal, a constant voltage drive for operating a driving transistor in a linear region, or a constant current drive for operating a driving transistor in a saturation region.

Embodiment Mode 2

Described in this embodiment mode is a pixel structure having at least a switching transistor, a driving transistor, a light emitting element, and a pass element.

Figure 3:
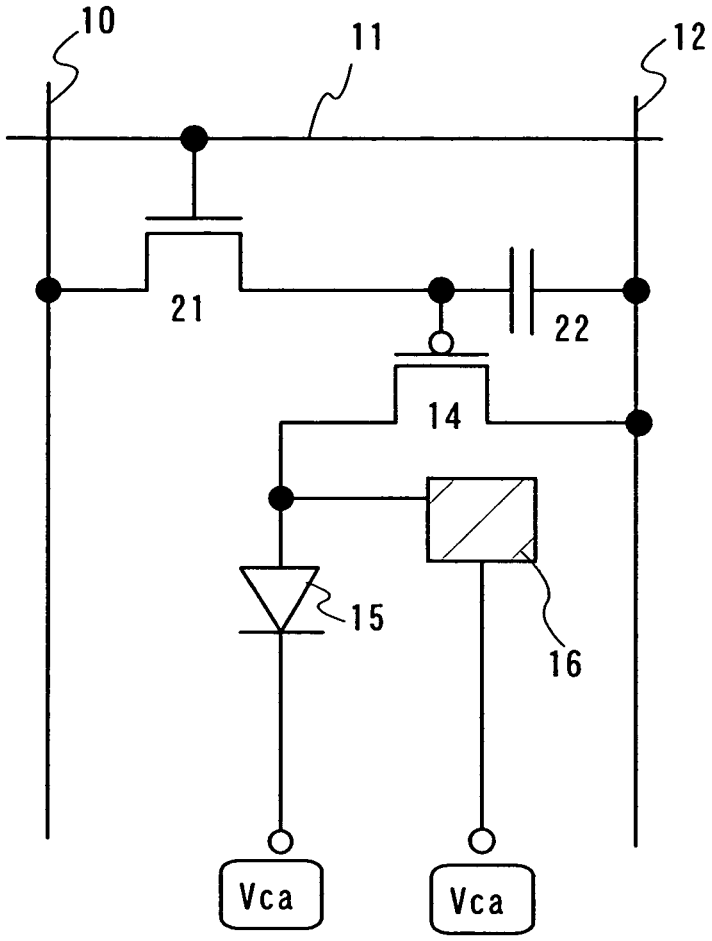
FIG. 3 is a circuit diagram showing a pixel of the invention.

A pixel shown in FIG. 3 has a signal line 10, a scan line 11, a switching transistor 21, a driving transistor 14, a light emitting element 15, a pass element 16, a power supply line 12, and a capacitor 22. The capacitor 22 is connected between a gate electrode and one of a source electrode and a drain electrode of the driving transistor 14. In this embodiment mode, an N-channel transistor is used as the switching transistor 21 while a P-channel transistor is used as the driving transistor 14.

When the switching transistor 21 is selected by the scan line 11, a video signal is inputted from the signal line 10. The video signal may be either a digital signal or an analog signal.

If a digital video signal is used, data on the video signal, namely charges are accumulated in the capacitor 22. When the accumulated charges exceed Vth of the driving transistor 14, the driving transistor 14 is turned on. Then, a current from the power supply line 12 is supplied to the light emitting element 15, thereby the light emitting element 15 emits light at a predetermined luminance.

When the driving transistor 14 is turned off, the light emitting element 15 emits no light. If the driving transistor 14 has an off current at this time, the off current flows through the light emitting element 15. Thus, the pass element 16 is provided so as to satisfy R (off)>Rp>>R (on), and more preferably R (off)>>Rp>>R (on). By flowing the off current of the driving transistor 14 to the pass element 16, the off current can be prevented from being supplied to the light emitting element 15. Note that it is preferable that R (off)>>Rp>>R (on) be satisfied, in which case most of the off current of the driving transistor 14 can flow through the pass element 16. As a result, high quality black display can be achieved.

Particularly when a reverse bias voltage is applied to the light emitting element 15, the invention can be suitably applied. In this case, the off current of the driving transistor 14 does not flow through the light emitting element 15 when the light emitting element 15 emits no light, thereby the display device can perform high quality black display.

When a digital video signal is inputted as described above, multi-gray scale display cannot be performed if nothing is done. Multi-gray scale display can be performed by using a time gray scale method for controlling a lighting time of a light emitting element.

Figure 17:
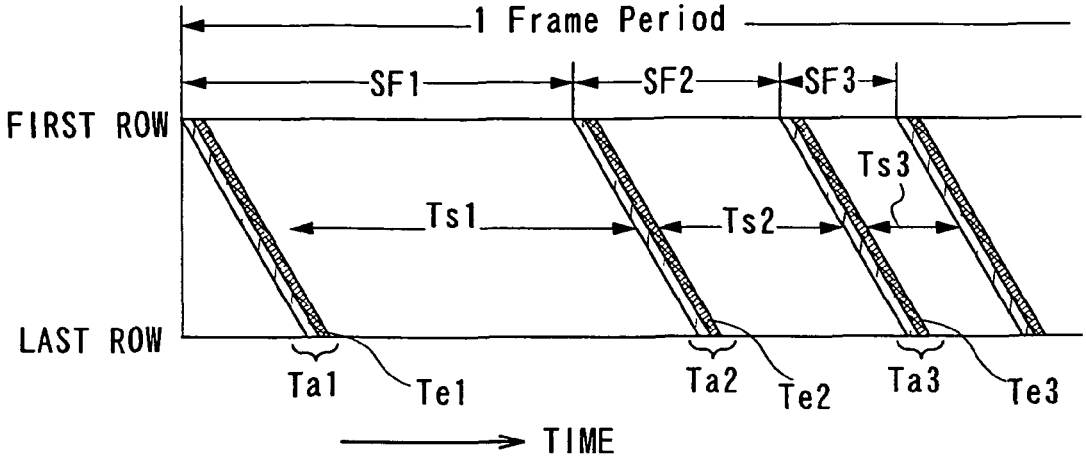
FIG. 17 is a timing chart showing operation of a pixel of the invention.

FIG. 17 shows a timing chart in the case of performing the time gray scale display using the pixel structure shown in FIG. 3. The vertical axis represents scan lines of the first row to the last row whereas the horizontal axis represents time. If three subframe periods (SF1 to SF3) are provided as shown in FIG. 17, 8-level gray scale display can be achieved. Each subframe period includes a writing period Ta1 to Ta3. Each writing period includes a period during which a video signal is inputted from the signal line 10 as well as a period (erasing period) Te1 to Te3 during which an erasing signal is inputted from the signal line 10. By controlling a lighting time of the light emitting element in this manner, 8-level gray scale display can be achieved.

As set forth above, the erasing period Te is provided in the writing period Ta by inputting a video signal or an erasing signal in one writing period, namely one gate selection period, thereby gray scale level is controlled. Accordingly, it is not necessary to provide an erasing transistor and is not necessary to increase the number of transistors in a pixel, which results in a higher aperture ratio.

Although the three subframe periods are provided in this embodiment mode, the invention it not limited to this and two subframe periods, or four or more subframe periods may be provided as well.

Figure 20:
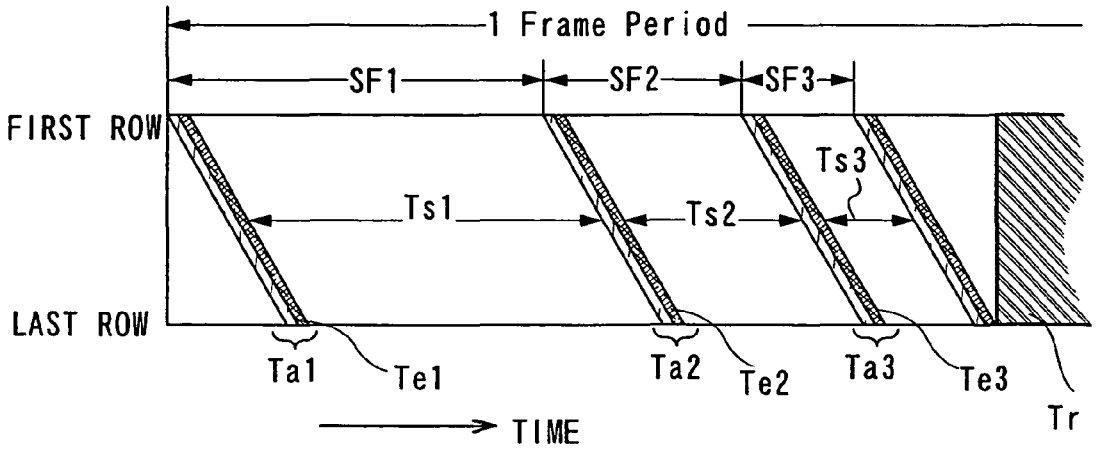
FIG. 20 is a timing chart showing operation of a pixel of the invention.

In addition to the writing period and the lighting period, a period for applying a reverse bias voltage to the light emitting element is preferably provided. When being applied with a reverse bias voltage to the light emitting element, the light emitting element can be improved in quality and last a long time. FIG. 20 shows a timing chart in the case of applying a reverse bias voltage. Note that a period Tr during which a reverse bias voltage is applied is not necessarily provided at the end of one frame period nor in each frame period. In the period for applying a reverse bias voltage, the potential of the power supply line 12 and the potential (Vca) of the cathode of the light emitting element 15 are inverted from each other. As a result, a reverse bias voltage can be applied to the light emitting element 15.

Although the subframe periods are arranged in sequence in FIG. 17, they may be arranged at random. According to this, pseudo contour can be prevented.

In this embodiment mode, the driving transistor 14 may operate in a linear region or a saturation region. Note that if the driving transistor 14 operates in a linear region, the driving voltage is not required to increase, leading to low power consumption. Note that, the driving transistor may have a double gate structure or an LDD structure if desired.

Embodiment Mode 3

Described in this embodiment mode is a pixel structure where an erasing transistor is added to the pixel structure shown in Embodiment Mode 2.

Figure 4:
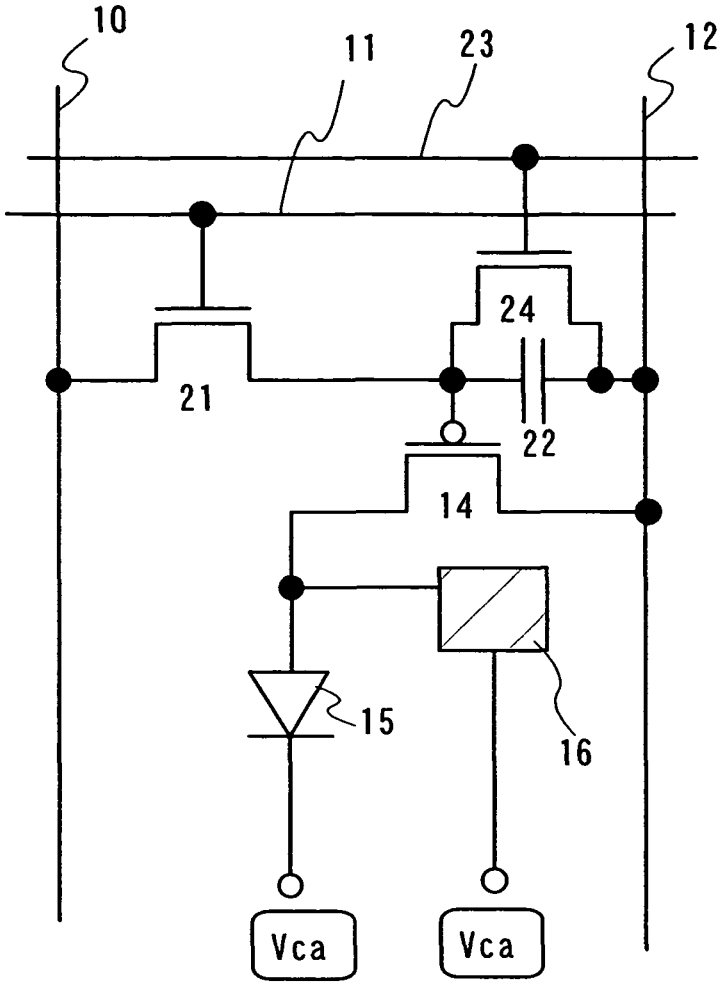
FIG. 4 is a circuit diagram showing a pixel of the invention.

A pixel shown in FIG. 4 has a signal line 10, a scan line 11, an erasing scan line 23, a e switching transistor 21, a e driving transistor 14, an erasing transistor 24, a light emitting element 15, a pass element 16, a e power supply line 12, and a capacitor 22. In this embodiment mode, an N-channel transistor is used as the switching transistor 21 and the erasing transistor 24, while a P-channel transistor is used as the driving transistor 14.

When the switching transistor 21 is selected by the scan line 11, a video signal is inputted from the signal line 10. The video signal may be either a digital signal or an analog signal. For example, if a digital video signal is used, data on the video signal, namely charges are accumulated in the capacitor 22. When the accumulated charges exceed Vgs of the driving transistor 14, the driving transistor 14 is turned on. Then, a current from the power supply line 12 is supplied to the light emitting element 15, thereby the light emitting element 15 emits light at a predetermined luminance.

When the light emitting element 15 emits no light, the erasing transistor 24 is turned on by the erasing scan line 23 and the charges accumulated in the capacitor 22 are discharged. Thus, the driving transistor 14 is turned off. If the driving transistor 14 has an off current at this time, the off current flows through the light emitting element 15. In order to prevent the off current from being supplied to the light emitting element 15, the off current of the driving transistor 14 flows through the pass element 16 that satisfies R (off) >Rp>>R (on), and more preferably R (off)>>Rp>>R (on). It is preferable that R (off)>>Rp>>R (on) be satisfied, in which case most of the off current of the driving transistor 14 can flow through the pass element 16. As a result, high quality black display can be achieved.

Particularly when a reverse bias voltage is applied to the light emitting element 15, the invention can be suitably applied. In this case, the off current of the driving transistor 14 does not flow through the light emitting element 15 when the light emitting element 15 emits no light, thereby the display device can perform high quality black display.

When a digital video signal is inputted as described above, multi-gray scale display cannot be performed if nothing is done. Multi-gray scale display may be performed by using a time gray scale method for controlling a lighting time of a light emitting element.

Figure 18:
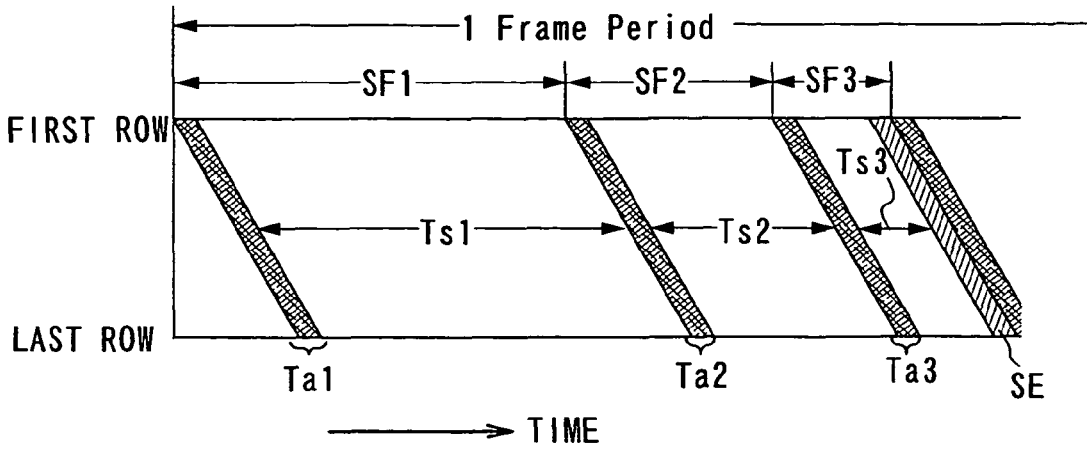
FIG. 18 is a timing chart showing operation of a pixel of the invention.

FIG. 18 shows a timing chart in the case of performing the time gray scale display using the pixel structure shown in FIG. 4. The vertical axis represents scan lines of the first row to the last row whereas the horizontal axis represents time. If three subframe periods (SF1 to SF3) are provided as shown in FIG. 18, 8-level gray scale display can be achieved. Each subframe period includes one of writing periods Ta1 to Ta3. After the writing periods Ta1 to Ta3, lighting periods Ts1 to Ts3 start respectively. In this manner, 8-level gray scale display can be performed. Further, in a short lighting period as Ts3, an erasing period SE during which the charges of the capacitor 22 are discharged by the erasing transistor 24 to forcibly stop light emission of the light emitting element 15 is preferably provided in order to start the first writing period Ta1 of the next frame period. As a result, duty ratio can be increased.

Although the subframe periods are arranged in sequence in FIG. 18, they may be arranged at random. According to this, pseudo contour can be prevented.

Although the three subframe periods are provided in this embodiment mode, the invention it not limited to this and two subframe periods, or four or more subframe periods may be provided as well.

In addition to the writing period and the lighting period, a period for applying a reverse bias voltage to the light emitting element may be provided. Applied with a reverse bias voltage, the light emitting element can be improved in quality and last a long time. For example, similarly to the timing chart shown in FIG. 20, a period Tr for applying a reverse bias voltage can be provided at the end of one frame period.

In this embodiment mode, the driving transistor 14 may operate in a linear region or a saturation region. Note that if the driving transistor 14 operates in a linear region, the driving voltage is not required to increase, leading to low power consumption. Note that, the driving transistor may have a double gate structure or an LDD structure if desired.

Embodiment Mode 4

Described in this embodiment mode is a pixel structure where a current control transistor is added to the pixel structures shown in Embodiment Modes 2 and 3.

Figure 5A:
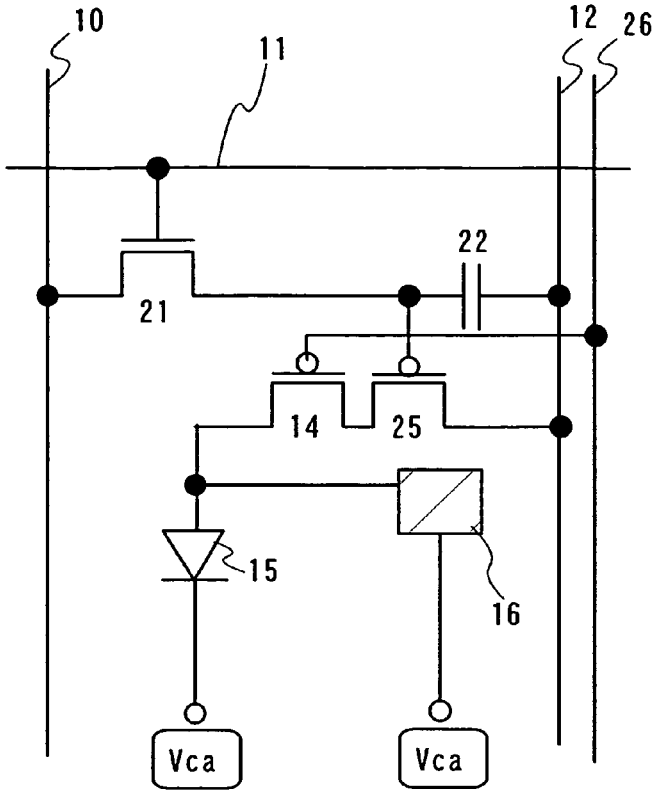
FIGS. 5A and 5B are circuit diagrams each showing a pixel of the invention.

A pixel shown in FIG. 5A has a signal line 10, a scan line 11, a constant potential line 26, a switching transistor 21, a driving transistor 14, a current control transistor 25, a e light emitting element 15, a e pass element 16, a power supply line 12, and a e capacitor 22. In this embodiment mode, an N-channel transistor is used as the switching transistor 21, while a P-channel transistor is used as the driving transistor 14 and the current control transistor 25.

When the switching transistor 21 is selected by the scan line 11, a video signal is inputted from the signal line 10. The video signal may be either a digital signal or an analog signal. For example, if a digital video signal is used, data on the video signal, namely charges are accumulated in the capacitor 22. When the accumulated charges exceed Vgs of the current control transistor 25, the current control transistor 25 is turned on. At this time, the driving transistor 14 as well as the current control transistor 25 is turned on. Then, a current from the power supply line 12 is supplied to the light emitting element 15, thereby the light emitting element 15 emits light at a predetermined luminance. Since the gate electrode of the driving transistor 14 is connected to the constant potential line 26, a gate-source voltage Vgs of the driving transistor 14 is maintained constant. The constant gate potential allows the driving transistor 14 to operate stably while preventing variations in the gate-source voltage Vgs due to parasitic capacitance or wiring capacitance. Accordingly, luminance unevenness caused by variations in characteristics of the driving transistor can be prevented. Thus, the causes of display unevenness are further reduced and quality of the display device can be significantly improved.

When the light emitting element 15 emits no light, the driving transistor 14 is turned off. If the driving transistor 14 has an off current at this time, the off current flows through the light emitting element 15. In order to prevent the off current from being supplied to the light emitting element 15, the off current of the driving transistor 14 flows through the pass element 16 that satisfies R (off)>Rp>>R (on), and more preferably R (off)>>Rp>>R (on). As a result, high quality black display can be achieved.

Particularly when a reverse bias voltage is applied to the light emitting element 15, the pixel shown in FIG. 5A can be suitably applied. In this case, the off current of the driving transistor 14 does not flow through the light emitting element 15 when the light emitting element 15 emits no light, thereby the display device can perform high quality black display.

When a digital video signal is inputted as described above, multi-gray scale display cannot be performed if nothing is done. Multi-gray scale display may be performed by using a time gray scale method for controlling a lighting time of a light emitting element.

Figure 6A:
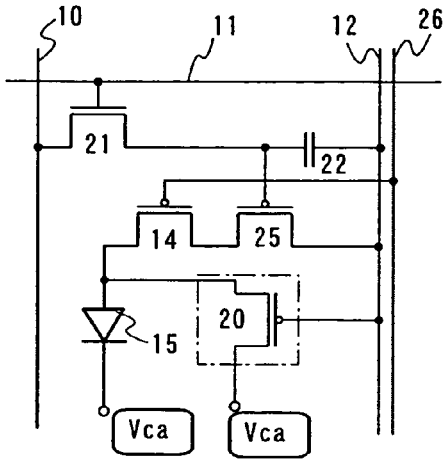
FIGS. 6A to 6C are circuit diagrams each showing a pixel of the invention.
Figure 6B:
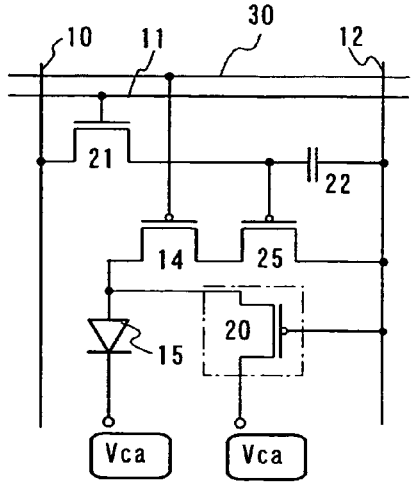
Figure 6C:
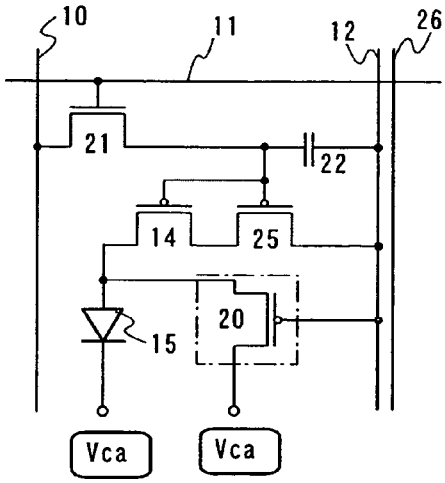

FIGS. 6A to 6C show equivalent circuit examples having the same function as the equivalent circuit shown in FIG. 5A. In FIGS. 6A to 6C, the P-channel thin film transistor 20 is used as the pass element 16, and one electrode of the P-channel thin film transistor 20 is connected to the counter electrode of the light emitting element 15.

In FIG. 6A, the P-channel thin film transistor 20 is connected to the light emitting element 15, and a gate electrode of the thin film transistor 20 is connected to the power supply line 12. Other structures are the same as those shown in FIG. 5A, therefore, the description thereof is omitted. When the light emitting element 15 emits no light in such a pixel circuit, the driving transistor 14 is turned off. If the driving transistor 14 has an off current at this time, the off current flows through the light emitting element 15. In order to prevent the off current from being supplied to the light emitting element 15, the off current flows through the P-channel thin film transistor 20 that satisfies R (off)>Rp>>R (on), and more preferably R (off)>>Rp>>R (on). When R (off)>>Rp>>R (on) is satisfied, most of the off current of the driving transistor 14 can flow through the P-channel thin film transistor 20. As a result, high quality black display can be achieved.

Particularly when a reverse bias voltage is applied to the light emitting element 15, the pixel shown in FIG. 6A can be suitably applied. In this case, the off current of the driving transistor 14 does not flow through the light emitting element 15 when the light emitting element 15 emits no light, thereby the display device can perform high quality black display.

An equivalent circuit diagram shown in FIG. 6B is different from that shown in FIG. 6A in that the gate electrode of the driving transistor 14 is connected to a control scan line 30 formed by the same material as the scan line 11. According to this, the number of power supply lines can be reduced. Other structures are the same as those shown in FIG. 6A, therefore, the circuit diagram shown in FIG. 5A can be referred to. When the light emitting element 15 emits no light in such a pixel circuit, the driving transistor 14 is turned off. If the driving transistor 14 has an off current at this time, the off current flows through the light emitting element 15. In order to prevent the off current of the driving transistor 14 from being supplied to the light emitting element 15, the off current flows through the P-channel thin film transistor 20 that satisfies R (off)>Rp>>R (on), and more preferably R (off) >>Rp>>R (on). When R (off)>>Rp>>R (on) is satisfied, most of the off current of the driving transistor 14 can flow through the P-channel thin film transistor 20. As a result, high quality black display can be achieved.

Particularly when a reverse bias voltage is applied to the light emitting element 15, the pixel shown in FIG. 6B can be suitably applied. In this case, the off current of the driving transistor 14 does not flow through the light emitting element 15 when the light emitting element 15 emits no light, thereby the display device can perform high quality black display.

An equivalent circuit diagram shown in FIG. 6C is different from that shown in FIG. 6A in that the gate electrode of the current control transistor 25 is connected to the gate electrode of the driving transistor 14. According to this, the number of control scan lines and power supply lines can be reduced. Other structures are the same as those shown in FIG. 6A, therefore, the circuit diagram shown in FIG. 5A can be referred to. When the light emitting element 15 emits no light in such a pixel circuit, the driving transistor 14 is turned off. If the driving transistor 14 has an off current at this time, the off current flows through the light emitting element 15. In order to prevent the off current of the driving transistor 14 from being supplied to the light emitting element 15, the off current flows through the P-channel thin film transistor 20 that satisfies R (off)>Rp>>R (on), and more preferably R (off)>>Rp>>R (on). When R (off)>>Rp>>R (on) is satisfied, most of the off current of the driving transistor 14 can flow through the P-channel thin film transistor 20. As a result, high quality black display can be achieved.

Particularly when a reverse bias voltage is applied to the light emitting element 15, the pixel shown in FIG. 6C can be suitably applied. In this case, the off current of the driving transistor 14 does not flow through the light emitting element 15 when the light emitting element 15 emits no light, thereby the display device can perform high quality black display.

It is needless to say that other elements may also be used as the pass element instead of the P-channel thin film transistor shown in FIGS. 6A to 6C.

Described next is a pixel shown in FIG. 5B. The pixel has a signal line 10, a scan line 11, an erasing scan line 23, a constant potential line 26, a switching transistor 21, a driving transistor 14, an erasing transistor 24, a current control transistor 25, a light emitting element 15, a pass element 16, a power supply line 12, and a capacitor 22. In this embodiment mode, an N-channel transistor is used as the switching transistor 21 and the erasing transistor 24, while a P-channel transistor is used as the driving transistor 14 and the current control transistor 25.

When the switching transistor 21 is selected by the scan line 11, a video signal is inputted from the signal line 10. The video signal may be either a digital signal or an analog signal. For example, if a digital video signal is used, data on the video signal, namely charges are accumulated in the capacitor 22. When the accumulated charges exceed Vgs of the current control transistor 25, the current control transistor 25 is turned on. At this time, the driving transistor 14 as well as the current control transistor 25 is turned on. Then, a current from the power supply line 12 is supplied to the light emitting element 15, thereby the light emitting element 15 emits light at a predetermined luminance. Since the gate electrode of the driving transistor 14 is connected to the constant potential line 26, a gate-source voltage Vgs of the driving transistor 14 is maintained constant. The constant gate potential allows the driving transistor 14 to operate stably while preventing variations in the gate-source voltage Vgs due to parasitic capacitance or wiring capacitance. Accordingly, luminance unevenness caused by variations in characteristics of the driving transistor can be prevented. Thus, the causes of display unevenness are further reduced and quality of the display device can be significantly improved.

When the light emitting element 15 emits no light, the erasing transistor 24 is turned on by the erasing scan line 23, and the charges accumulated in the capacitor 22 are discharged. Thus, the driving transistor 14 is turned off. If the driving transistor 14 has an off current at this time, the off current flows through the light emitting element 15. In order to prevent the off current from being supplied to the light emitting element 15, the off current of the driving transistor 14 flows through the pass element 16 that satisfies R (off) >Rp>>R (on), and more preferably R (off)>>Rp>>R (on). When R (off)>>Rp>>R (on) is satisfied, most of the off current of the driving transistor 14 can flow through the pass element 16. As a result, high quality black display can be achieved.

Figure 5B:
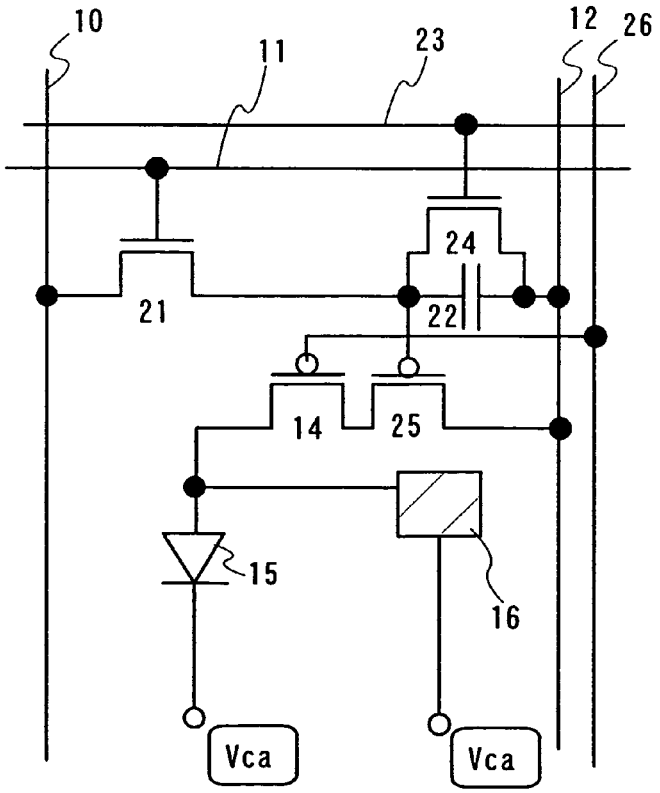

Particularly when a reverse bias voltage is applied to the light emitting element 15, the pixel shown in FIG. 5B can be suitably applied. In this case, the off current of the driving transistor 14 does not flow through the light emitting element 15 when the light emitting element 15 emits no light, thereby the display device can perform high quality black display.

When a digital video signal is inputted as described above, multi-gray scale display cannot be performed if nothing is done. Multi-gray scale display may be performed by using a time gray scale method for controlling a lighting time of a light emitting element.

Figure 7A:
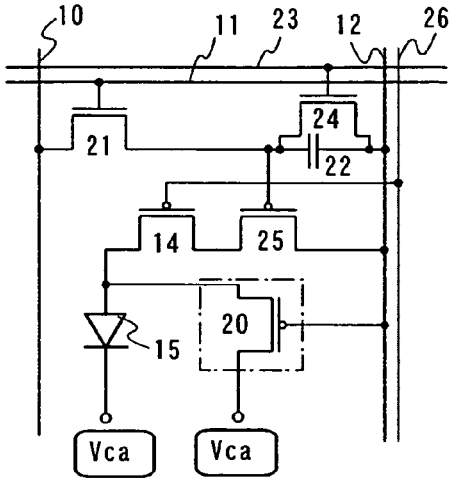
FIGS. 7A to 7C are circuit diagrams each showing a pixel of the invention.
Figure 7B:
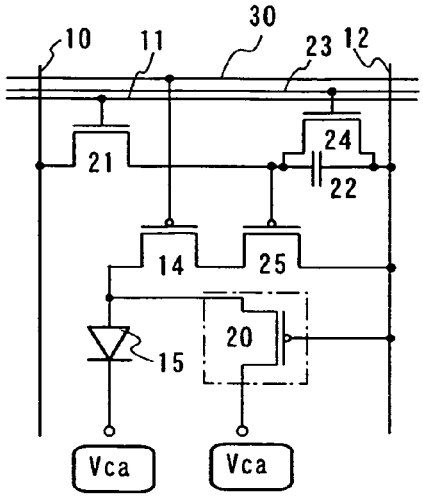
Figure 7C:
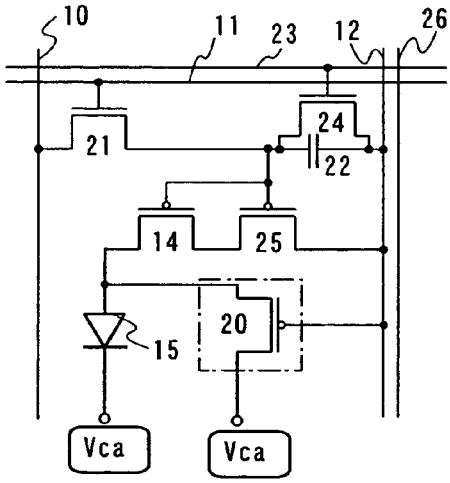

FIGS. 7A to 7C show equivalent circuit examples having the same function as the equivalent circuit shown in FIG. 5B. In FIGS. 7A to 7C, the P-channel thin film transistor 20 is used as the pass element 16, and one electrode of the P-channel thin film transistor 20 is connected to the counter electrode of the light emitting element 15.

In FIG. 7A, the P-channel thin film transistor 20 is connected to the light emitting element 15, and the gate electrode of the thin film transistor 20 is connected to the power supply line 12. Other structures are the same as those shown in FIG. 5B, therefore, the description thereof is omitted. When the light emitting element 15 emits no light in such a pixel circuit, the driving transistor 14 is turned off. If the driving transistor 14 has an off current at this time, the off current flows through the light emitting element 15. In order to prevent the off current from being supplied to the light emitting element 15, the off current of the driving transistor 14 flows through the P-channel thin film transistor 20 that satisfies R (off)>Rp>>R (on), and more preferably R (off)>>Rp>>R (on). When R (off)>>Rp>>R (on) is satisfied, most of the off current of the driving transistor 14 can flow through the P-channel thin film transistor 20. As a result, high quality black display can be achieved.

Particularly when a reverse bias voltage is applied to the light emitting element 15, the pixel shown in FIG. 7A can be suitably applied. In this case, the off current of the driving transistor 14 does not flow through the light emitting element 15 when the light emitting element 15 emits no light, thereby the display device can perform high quality black display.

An equivalent circuit diagram shown in FIG. 7B is different from that shown in FIG. 7A in that the gate electrode of the driving transistor 14 is connected to the control scan line 30 formed by the same material as the scan line 11. Accordingly, the number of power supply lines can be reduced. Other structures are the same as those shown in FIG. 7A, therefore, the circuit diagram shown in FIG. 5B can be referred to. When the light emitting element 15 emits no light in such a pixel circuit, the driving transistor 14 is turned off. If the driving transistor 14 has an off current at this time, the off current flows through the light emitting element 15. In order to prevent the off current from being supplied to the light emitting element 15, the off current of the driving transistor 14 flows through the P-channel thin film transistor 20 that satisfies R (off)>Rp>>R (on), and more preferably R (off)>>Rp>>R (on). As a result, high quality black display can be achieved.

Particularly when a reverse bias voltage is applied to the light emitting element 15, the pixel shown in FIG. 7B can be suitably applied. In this case, the off current of the driving transistor 14 does not flow through the light emitting element 15 when the light emitting element 15 emits no light, thereby the display device can perform high quality black display.

An equivalent circuit diagram shown in FIG. 7C is different from that shown in FIG. 7A in that the gate electrode of the current control transistor 25 is connected to the gate electrode of the driving transistor 14. Accordingly, the number of control scan lines and power supply lines can be reduced. Other structures are the same as those shown in FIG. 7A, therefore, the circuit diagram shown in FIG. 5B can be referred to. When the light emitting element 15 emits no light in such a pixel circuit, the driving transistor 14 is turned off. If the driving transistor 14 has an off current at this time, the off current flows through the light emitting element 15. In order to prevent the off current from being supplied to the light emitting element 15, the off current of the driving transistor 14 flows through the P-channel thin film transistor 20 that satisfies R (off)>Rp>>R (on), and more preferably R (off)>>Rp>>R (on). When R (off)>>Rp>>R (on) is satisfied, most of the off current of the driving transistor 14 can flow through the P-channel thin film transistor 20. As a result, high quality black display can be achieved.

Particularly when a reverse bias voltage is applied to the light emitting element 15, the pixel shown in FIG. 7C can be suitably applied. In this case, the off current of the driving transistor 14 does not flow through the light emitting element 15 when the light emitting element 15 emits no light, thereby the display device can perform high quality black display. Note that, the driving transistor may have a double gate structure or an LDD structure if desired.

Although P-channel thin film transistor is used as the pass element in FIGS. 5A to 7C, it is needless to say that the other elements as shown in FIGS. 2A to 2D may also be used as the pass element.

Embodiment Mode 5

Described in this embodiment mode is one mode of a display device having the pixel of the invention.

Figure 10:
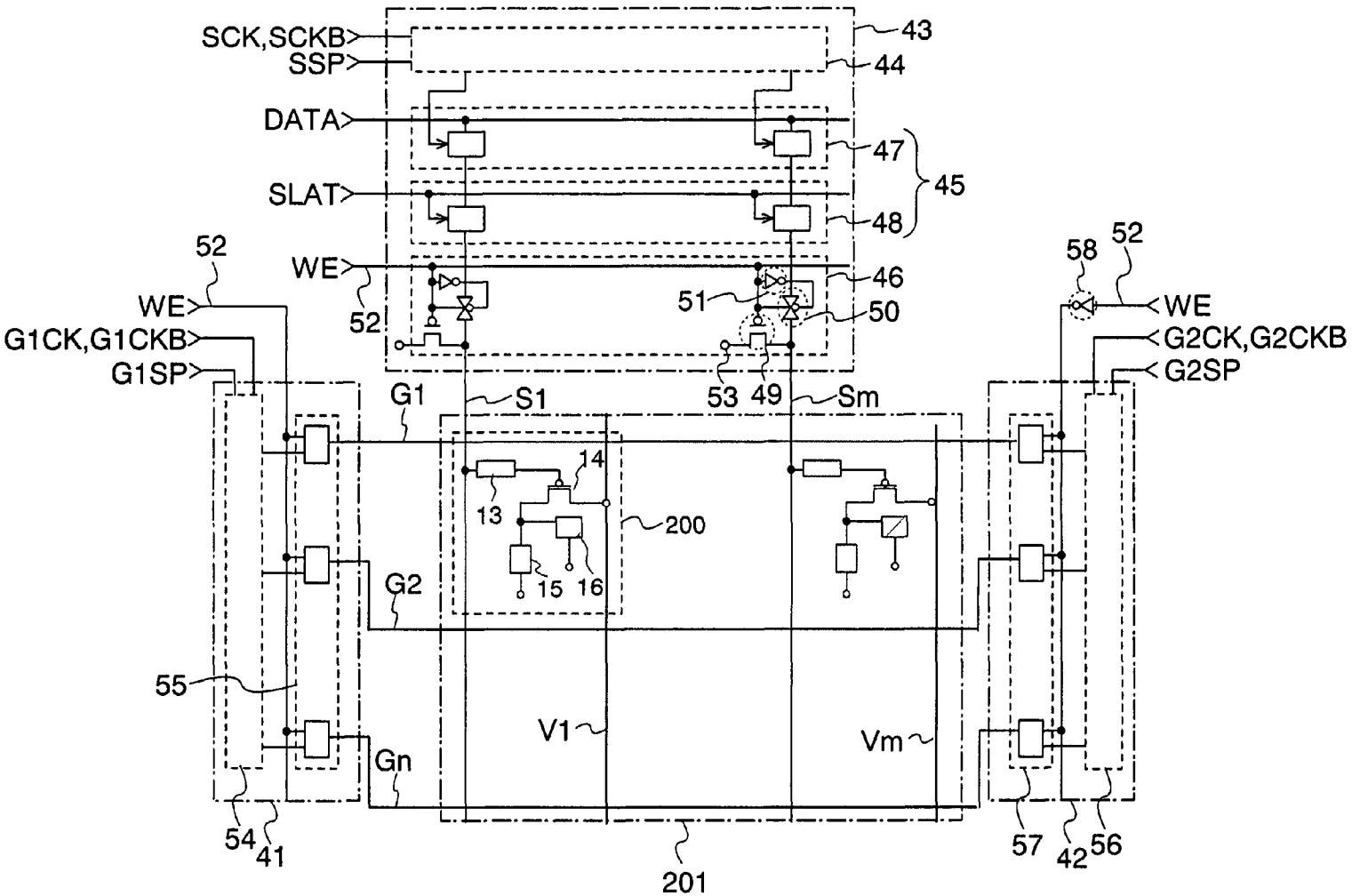
FIG. 10 is a diagram showing a display device of the invention.

As shown in FIG. 10, a display device including the pixel described in the aforementioned embodiment modes has a pixel area 201 where a plurality of the aforementioned pixels are arranged in matrix, a first gate driver 41, a second gate driver 42, and a source driver 43. The first gate driver 41 and the second gate driver 42 are disposed so as to face each other with the pixel area 201 interposed therebetween, or disposed on one of the four sides (on the left, right, top and bottom) of the pixel area 201.

The source driver 43 has a pulse output circuit 44, a latch 45, and a selection circuit 46. The latch 45 includes a first latch 47 and a second latch 48. The selection circuit 46 includes a transistor 49 (hereinafter referred to as a TFT 49) and an analog switch 50. The TFT 49 and the analog switch 50 are provided for each column corresponding to a signal line (S1 to Sm). An inverter 51 generates an inverted signal of a WE (Write Erase) signal, and is not necessarily provided when an inverted signal of a WE signal is supplied externally. A gate electrode of the TFT 49 is connected to a selection signal line 52, and one of a source electrode and a drain electrode thereof is connected to the signal line (S1 to Sm) while the other is connected to a power supply 53. The analog switch 50 is provided between the second latch 48 and the signal line (S1 to Sm). That is, an input node of the analog switch 50 is connected to the second latch 48 and an output node thereof is connected to the signal line Sm. One of two control nodes of the analog switch 50 is connected to the selection signal line 52 whereas the other is connected to the selection signal line 52 through the inverter 51. The potential of the power supply 53 is a potential that turns off the driving transistor 14 in the pixel, which is at an L (Low) level when the driving transistor 14 is an N-channel transistor while at an H (High) level when the driving transistor 14 is a P-channel transistor.

The first gate driver 41 has a pulse output circuit 54 and a selection circuit 55. The second gate driver 42 has a pulse output circuit 56 and a selection circuit 57. The selection circuits 55 and 57 are connected to the selection signal lines 52, though the selection circuit 57 included in the second gate driver 42 is connected to the selection signal line 52 through an inverter 58. That is, WE signals inputted from the selection signal lines 52 to the selection circuits 55 and 57 are inverted from each other.

Each of the selection circuits 55 and 57 has a tri-state buffer. An input node of the tri-state buffer is connected to the pulse output circuit 54 or the pulse output circuit 56, and a control node of the tri-state buffer is connected to the selection signal line 52. Each of an output node of the tri-state buffer is connected to a corresponding scan line (G1 to Gn). The tri-state buffer is brought into an operating state when an H level signal is transmitted from the selection signal line 52 while it is brought into a floating state when an L level signal is transmitted from the selection signal line 52.

The pulse output circuit 44 included in the source driver 43, the pulse output circuit 54 included in the first gate driver 41, and the pulse output circuit 56 included in the second gate driver 42 each has a decoder circuit or a shift register constituted by a plurality of flip flop circuits. When a decoder circuit is used as the pulse output circuits 44, 54, and 56, the signal line (S1 to Sm) or the scan line (G1 to Gn) can be selected at random. Selecting the signal line (S1 to Sm) or the scan line (G1 to Gn) at random prevents pseudo contour that occurs when the time gray scale method is adopted.

The structure of the source driver 43 is not limited to the aforementioned one, and a level shifter and a buffer may be additionally provided. The structures of the first gate driver 41 and the second gate driver 42 are also not limited to the aforementioned ones, and a level shifter and a buffer may be additionally provided. Further, the source driver 43, the first gate driver 41, and the second gate driver 42 may have a protection circuit. The protection circuit can reduce electrostatic discharge damage and the like.

The display device of the invention may also have a power supply control circuit. The power supply control circuit has a controller and a power supply circuit for supplying a power supply to the light emitting element 15. The power supply circuit is connected to the pixel electrode of the light emitting element 15 through the driving transistor 14 and the power supply line (V1 to Vm). The power supply circuit is also connected to the counter electrode of the light emitting element 15 through the power supply line.

When a forward bias voltage (forward voltage) is applied to the light emitting element 15 by such a current supply control circuit such that the light emitting element 15 is supplied with current and emits light, the potential difference between the power supply line V1 and the counter electrode of the light emitting element 15 is set so that the potential of the power supply line V1 is higher than that of the counter electrode of the light emitting element 15. Meanwhile, when a reverse bias voltage is applied to the light emitting element 15, the potential difference between the power supply line V1 and the counter electrode of the light emitting element 15 is set so that the potential of the power supply line V1 is lower than that of the counter electrode of the light emitting element 15. Such setting of the power supplies can be performed by supplying a predetermined signal from the controller to the power supply circuit.

When a reverse bias voltage is thus applied to the light emitting element 15, degradation with time thereof can be suppressed and reliability can be increased. In addition, it is possible to prevent an initial defect of the light emitting element 15, where an anode and a cathode are short-circuited due to the deposition of foreign material, pinholes caused by a slight unevenness of the anode or the cathode, and unevenness of an electroluminescent layer.

The display device may also have a monitor circuit and a control circuit. The monitor circuit operates depending on the surrounding temperature (hereinafter referred to as ambient temperature). The control circuit has a constant current source and a buffer. The monitor circuit has a monitoring light emitting element.

Such a control circuit can supply a signal to the current supply control circuit for changing a power supply potential depending on the output of the monitor circuit. Then, the power supply control circuit changes the power supply potential supplied to the pixel area 201 depending on the signal supplied from the control circuit. As a result, variations in current due to changes in the ambient temperature can be suppressed, leading to increased reliability.

Embodiment Mode 6

Described in this embodiment mode are signals for driving a pixel. According to a driving method shown in this embodiment mode, one gate selection period has a writing period of a video signal and a writing period of an erasing signal similarly to the timing chart shown in FIG. 17. Such a driving method can be applied to any of the pixel structures shown in the aforementioned embodiment modes. In addition, in the pixel structure including an erasing transistor, the erasing transistor can be omitted to achieve a high aperture ratio. Note that the display device can be configured with reference to FIG. 10.

Figure 11A:
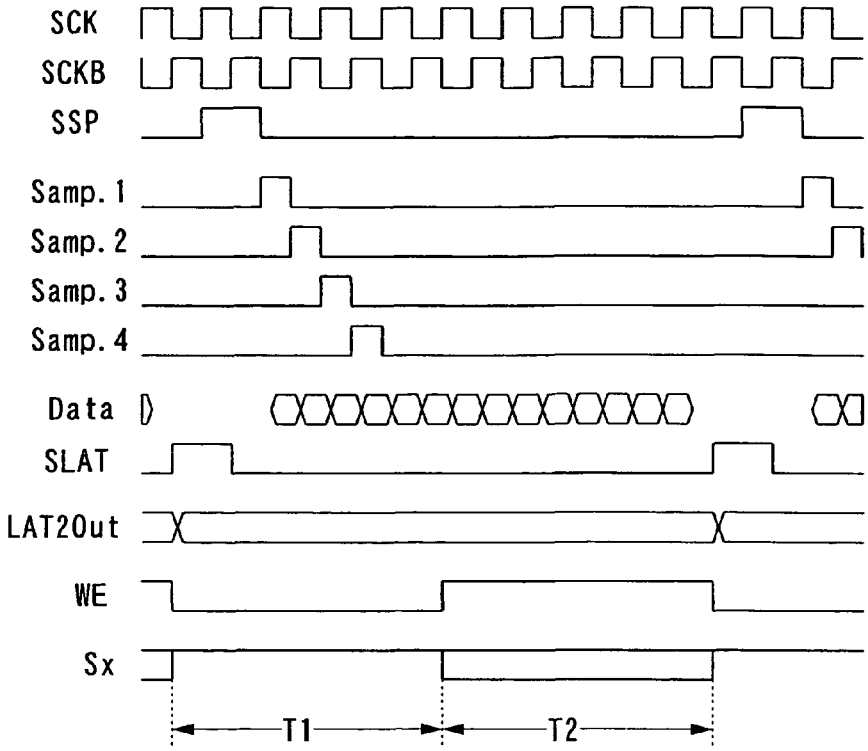
FIGS. 11A and 11B are diagrams each showing operation waveforms of a pixel of the invention.
Figure 11B:
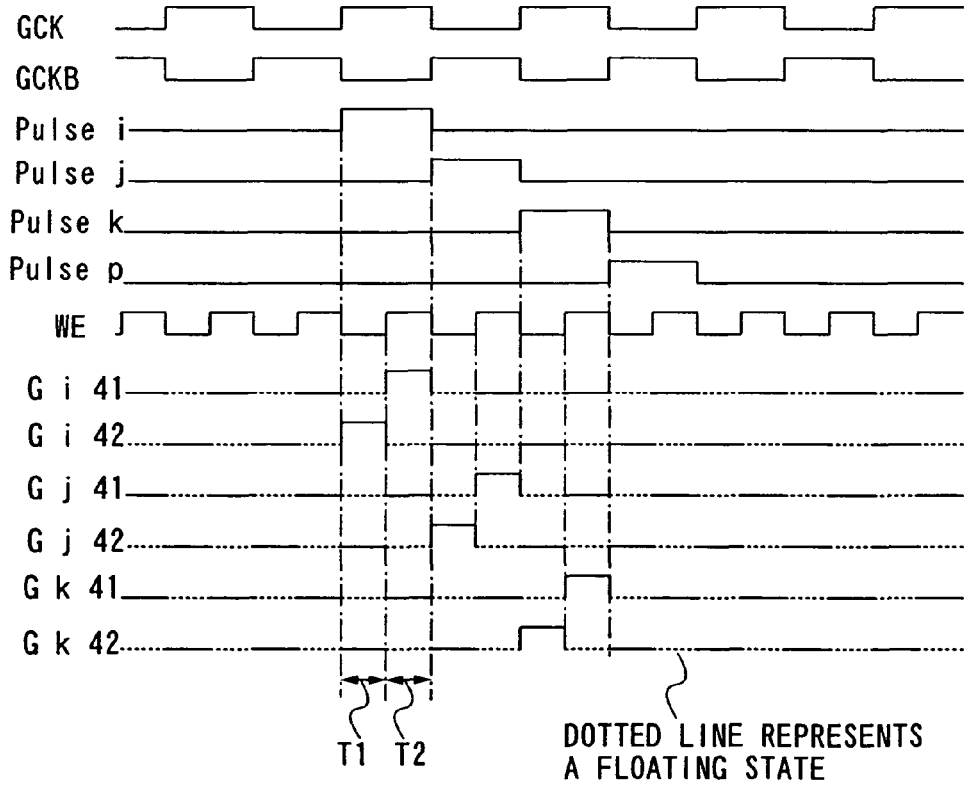

Operation of the display device is described with reference to FIGS. 11A and 11B. First, operation of a source driver is described with reference to FIG. 11A. A clock signal (hereinafter referred to as SCK), a clock inverted signal (hereinafter referred to as SCKB), and a start pulse (hereinafter referred to as SSP) are inputted to the pulse output circuit 44. A sampling pulse is outputted to the first latch 47 at the timing of these signals. The first latch 47 to which data is inputted holds video signals of the first to last columns when the sampling pulse is inputted thereto. When a latch pulse is inputted to the second latch 48, the video signals held in the first latch 47 are simultaneously transmitted to the second latch 48.

When it is assumed that an L level WE signal is transmitted from the selection signal line 52 during a period T1 while an H level WE signal is transmitted during a period T2, the selection circuit 46 operates during each period in the following manner. Each of the periods T1 and T2 corresponds to half of a horizontal scan period, and the period T1 is called a first subgate selection period whereas the period T2 is called a second subgate selection period.

During the period T1 (first subgate selection period), an L level WE signal is transmitted from the selection signal line 52, the TFT 49 is turned on, and the analog switch 50 is brought into a non-conductive state. Then, the plurality of signal lines (S1 to Sm) are electrically connected to the power supply 53 through the TFT 49 provided in each column. That is, the potentials of the signal lines (S1 to Sm) become equal to the potential of the power supply 53. At this time, the switching element 13 included in the pixel 200 is on, and the potential of the power supply 53 is transmitted to the gate electrode of the driving transistor 14 through the switching element 13. Thus, the driving transistor 14 is turned off and the two electrodes of the light emitting element 15 have the same potential. That is, no current flows through the two electrodes of the light emitting element 15, thereby no light is emitted. In this manner, the potential of the power supply 53 is transmitted to the gate electrode of the driving transistor 14 regardless of the state of a video signal, thus the switching element 13 is turned off and the two electrodes of the light emitting element 15 have the same potential. Such operation is called erasing operation.

During the period T2 (second subgate selection period), an H level WE signal is transmitted from the selection signal line 52, the TFT 49 is turned off, and the analog switch 50 is brought into a conductive state. Then, the video signals held in the second latch 48 are simultaneously transmitted to the plurality of signal lines (S1 to Sm) for one row. At this time, the switching element 13 included in the pixel is on, and the video signal is transmitted to the gate electrode of the driving transistor 14 through the switching element 13. Thus, the driving transistor 14 is turned on or off depending on the inputted video signal, thereby the two electrodes of the light emitting element 15 have different potentials or the same potential. More specifically, when the driving transistor 14 is turned on, the two electrodes of the light emitting element 15 have different potentials and a current flows therethrough, then, the light emitting element 15 emits light. Note that the same current flows through the light emitting element 15 and between the source and the drain of the driving transistor 14. On the other hand, when the driving transistor 14 is turned off, the two electrodes of the light emitting element 15 have the same potential and no current flows therethrough, namely, the light emitting element 15 emits no light. In this manner, the driving transistor 14 is turned on or off depending on a video signal, and the two electrodes of the light emitting element 15 have different potentials or the same potential. Such operation is called writing operation.

Operation of the first gate driver 41 and the second gate driver 42 is described next with reference to FIG. 11B. A clock signal for the first gate driver (G1CK), a clock inverted signal for the first gate driver (G1CKB), and a start pulse signal for the first gate driver (G1SP) are inputted to the pulse output circuit 54, and pulses are sequentially outputted to the selection circuit 55 at the timing of these signals. A clock signal for the second gate driver (G2CK), a clock inverted signal for the second gate driver (G2CKB), and a start pulse signal for the second gate driver (G2SP) are inputted to the pulse output circuit 56, and pulses are sequentially outputted to the selection circuit 57 at the timing of these signals. FIG. 11B shows the potentials of pulses supplied to the selection circuits 55 and 57 of the i-th, j-th, k-th, and p-th rows (i, j, k, and p are natural numbers, 1=i, j, k, p=n).

When it is assumed that an L level WE signal is transmitted from the selection signal line 52 during a period T1 while an H level WE signal is transmitted during a period T2 similarly to the description for the operation of the source driver 43, the selection circuit 55 in the first gate driver 41 and the selection circuit 57 in the second gate driver 42 operate in each period in the following manner. Note that in the timing chart of FIG. 11B, the potential of the scan line (G1 to Gn) that receives a signal from the first gate driver 41 is denoted by Gn41, while the potential of the scan line (G1 to Gn) that receives a signal from the second gate driver 42 is denoted by Gn42. It is needless to say that Gn41 and Gn42 denote the same wiring.

In the period T1 (first subgate selection period), an L level WE signal is transmitted from the selection signal line 52. Thus, an L level WE signal is inputted to the selection circuit 55 in the first gate driver 41, thereby the selection circuit 55 is brought into a floating state. On the other hand, an inverted WE signal, namely an H level WE signal is inputted to the selection circuit 57 in the second gate driver 42, thereby the selection circuit 57 is brought into an operating state. That is, the selection circuit 57 transmits an H level signal (row selection signal) to a scan line Gi of the i-th row such that the scan line Gi has the same potential as the H level signal. In other words, the scan line Gi of the i-th row is selected by the second gate driver 42. As a result, the switching element 13 included in the pixel is turned on. Then, the potential of the power supply 53 included in the source driver 43 is transmitted to the gate electrode of the driving transistor 14, thereby the driving transistor 14 is turned off and the two electrodes of the light emitting element 15 have the same potential. That is, the erasing operation where the light emitting element 15 emits no light is performed in this period.

In the period T2 (second subgate selection period), an H level WE signal is transmitted from the selection signal line 52. Thus, an H level WE signal is inputted to the selection circuit 55 in the first gate driver 41, thereby the selection circuit 55 is brought into an operating state. That is, the selection circuit 55 transmits an H level signal to the scan line Gi of the i-th row such that the scan line Gi has the same potential as the H level signal. Thus, the scan line Gi of the i-th row is selected by the first gate driver 41. As a result, the switching element 13 included in the pixel is turned on. Then, a video signal is transmitted from the second latch 48 in the source driver 43 to the gate electrode of the driving transistor 14, thereby the driving transistor 14 is turned on or off and the two electrodes of the light emitting element 15 have different potentials or the same potential. That is, the writing operation where the light emitting element 15 emits light or no light is performed in this period. Meanwhile, an L level signal is inputted to the selection circuit 57 in the second gate driver 42, and the selection circuit 57 is brought into a floating state.

As set forth above, the scan line Gn is selected by the second gate driver 42 during the period T1 (first subgate selection period) while selected by the first gate driver 41 during the period T2 (second subgate selection period). That is, the scan line is controlled by the first gate driver 41 and the second gate driver 42 in a complementary manner. The erasing operation is performed during one of the first and second subgate selection periods, and the writing operation is performed during the other period.

During a period when the first gate driver 41 selects the scan line Gi of the i-th row, the second gate driver 42 does not operate (selection circuit 57 is in a floating state), or transmits a row selection signal to the scan lines of the rows other than the i-th row. Similarly, during a period when the second gate driver 42 transmits a row selection signal to the scan line Gi of the i-th row, the first gate driver 41 is in a floating state, or transmits a row selection signal to the scan lines of the rows other than the i-th row.

According to the invention performing the aforementioned operation, the light emitting element 15 can be turned off forcibly, leading to an increased duty ratio even when the gray scale level is increased. Further, the light emitting element 15 can be turned off forcibly without providing a TFT for discharging the charges of the capacitor, which results in a high aperture ratio. When the high aperture ratio is achieved, the luminance of the light emitting element can be reduced with the increase in light emitting area. That is, the driving voltage can be reduced and thus power consumption can be reduced.

The invention is not limited to this embodiment mode where a gate selection period is divided into two periods. The gate selection period may be divided into three or more periods. This embodiment mode can be freely combined with the aforementioned embodiment modes.

Note that an erasing signal is inputted to a pixel during the first half of the gate selection period (first subgate selection period) while a video signal is inputted to the pixel during the second half of the gate selection period (second subgate selection period), though the invention is not limited to this. Alternatively, a video signal may be inputted to a pixel during the first half of the gate selection period (first subgate selection period) while an erasing signal may be inputted to the pixel during the second half of the gate selection period (second subgate selection period).

Further alternatively, a video signal may be inputted to a pixel during both the first half of the gate selection period (first subgate selection period) and the second half of the gate selection period (second subgate selection period). In this case, signals corresponding to different subframe periods may be inputted during each period. As a result, subframe periods can be provided so that lighting periods are sequentially arranged without an erasing period. Since no erasing period is required in such a case, duty ratio can be increased.

Embodiment Mode 7

Described in this embodiment mode is a pixel structure that is different from those shown in the aforementioned embodiment modes.

Figure 8:
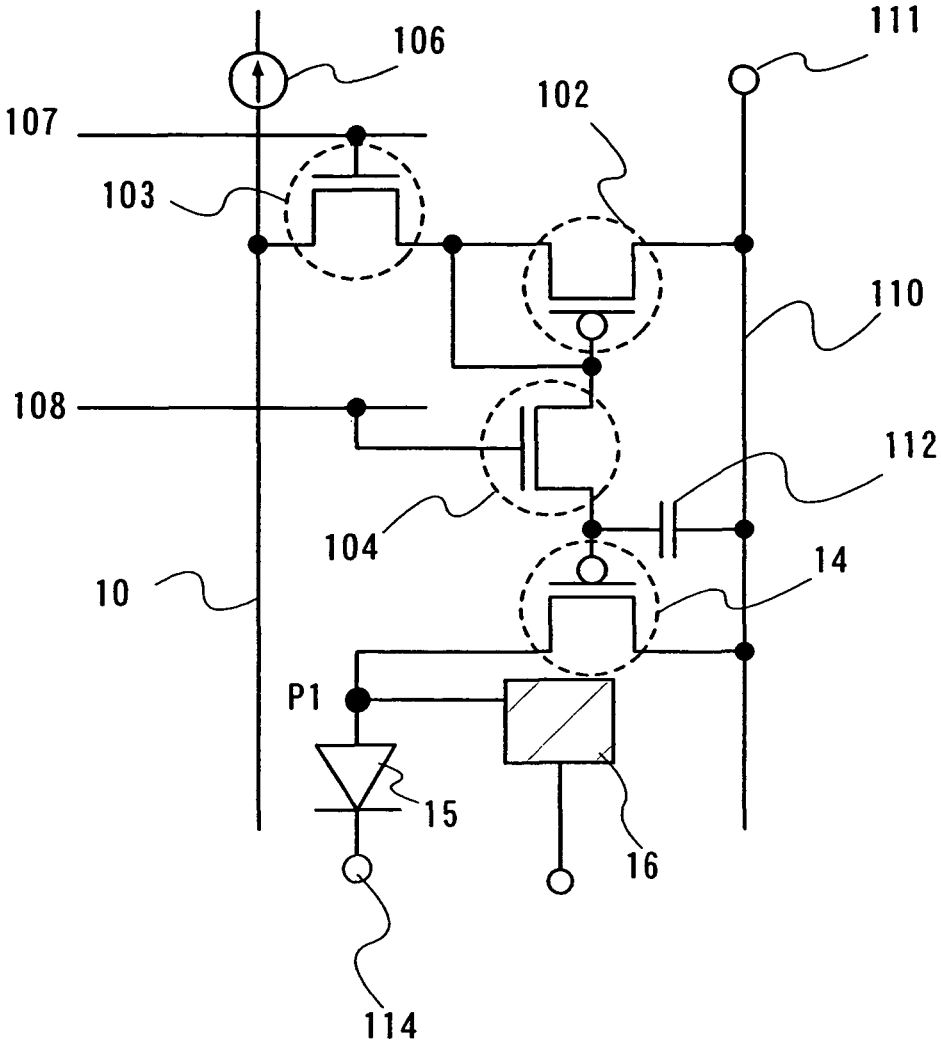
FIG. 8 is a circuit diagram showing pixel of the invention.

A pixel shown in FIG. 8 has a light emitting element 15, a switching transistor 103, a holding transistor 104, a driving transistor 14, a converting transistor 102, a pass element 16, and a capacitor 112. A gate electrode of the switching transistor 103 is connected to a first scan line 107, one of a source electrode and a drain electrode thereof is connected to the signal line 10, and the other is connected to a gate electrode of the converting transistor 102. One of a source electrode and a drain electrode of the converting transistor 102 is connected to a power supply line 110, and the other is connected to the gate electrode of the converting transistor 102. A gate electrode of the holding transistor 104 is connected to a second scan line 108, one of a source electrode and a drain electrode thereof is connected to the gate electrode of the converting transistor 102, and the other is connected to the gate electrode of the driving transistor 14. One of the source electrode and the drain electrode of the driving transistor 14 is connected to the power supply line 110, and the other is connected to the pixel electrode of the light emitting element 15. The counter electrode of the light emitting element 15 is connected to a second power supply 114. The capacitor 112 is connected between the gate electrode of the driving transistor 14 and the power supply line 110, and the pass element 16 is connected to the pixel electrode of the light emitting element 15. The signal line 10 is connected to a current source 106 that is controlled depending on luminance data, and the power supply line 110 is connected to a first power supply 111.

The conductivity of the switching transistor 103 and the holding transistor 104 is not limited, and either an N-channel transistor or a P-channel transistor may be used. The conductivity of the driving transistor 14 and the converting transistor 102 is also not limited, though they are required to have the same conductivity. If a current flows from the pixel electrode to the counter electrode of the light emitting element 15 to emit light, a P-channel transistor is desirably used as the driving transistor 14 and the converting transistor 102 as shown in FIG. 8. Meanwhile, if a current flows from the counter electrode to the pixel electrode of the light emitting element 15 to emit light, an N-channel transistor is desirably used as the driving transistor 14 and the converting transistor 102.

The pass element 16 is turned off when the light emitting element 15 emits light, and has a function of flowing the off current of the driving transistor 14 when the light emitting element 15 emits no light. The pass element 16 may be any of the P-channel thin film transistor 20 and other elements shown in FIGS. 2A to 2D.

The pass element 16 is set such that when the driving transistor 14 has an off current in a non-lighting period, the off current flows through the pass element 16. Specifically, the pass element 16 is provided so as to satisfy R (off)>Rp>>R (on), and more preferably R (off)>>Rp>>R (on). When R (off)>>Rp>>R (on) is satisfied, most of the off current of the driving transistor 14 can flow through the pass element 16. The off current of the driving transistor 14 is not supplied to the light emitting element 15 by flowing the off current to the pass element 16, therefore, high quality black display can be achieved.

Figure 9A:
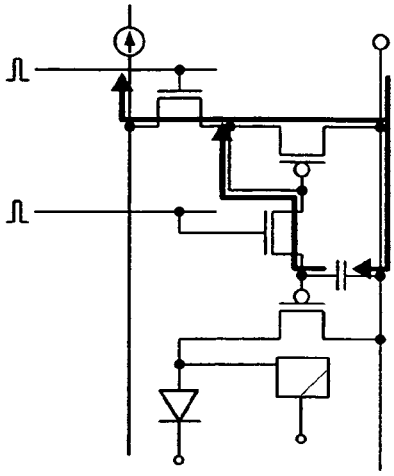
FIGS. 9A to 9C are diagrams each showing operation of a pixel of the invention.
Figure 9B:
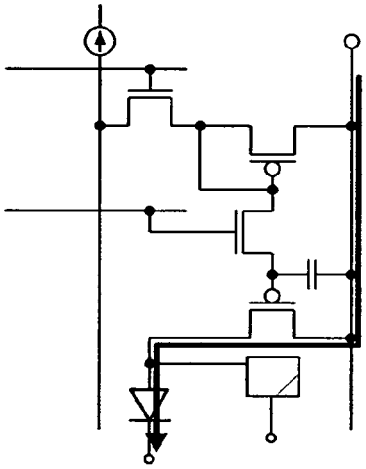
Figure 9C:
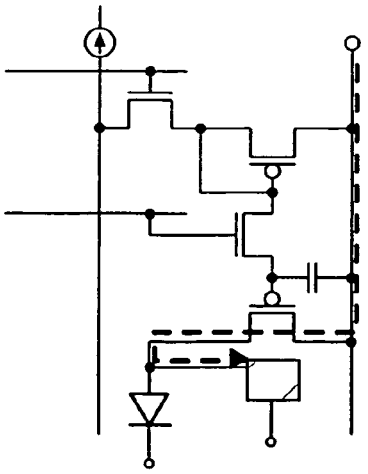

Operation of the pixel structure shown in FIG. 8 is described. As shown in FIGS. 9A to 9C, operation of the pixel can be divided into a programming period, a lighting period, and a non-lighting period.

During a programming period shown in FIG. 9A, an H level signal is inputted to the first scan line 107 and the second scan line 108 to turn on the switching transistor 103 and the holding transistor 104, thereby the current source 106 is connected to the converting transistor 102 and a signal current Idata corresponding to luminance data flows between the source and the drain of the converting transistor 102. At this time, since the gate electrode and the drain electrode of the converting transistor 102 are connected to each other, the converting transistor 102 operates in a saturation region. Accordingly, a gate-source voltage required for the signal current Idata to flow between the source and the drain of the converting transistor 102 is held in the capacitor 112. Then, an L level signal is inputted to the first scan line 107 and the second scan line 108 to turn off the switching transistor 103 and the holding transistor 104, the programming period is completed and a lighting period starts. It is preferable in this case that an L level signal be outputted to the second scan line 108 before the first scan line 107 and the holding transistor 104 be turned off before the switching transistor 103.

During a lighting period shown in FIG. 9B, a current Idriv is supplied from the driving transistor 14 to the light emitting element 15 depending on a potential difference that has been held in the capacitor 112 in the programming period. At this time, it is necessary to control the second power supply 114 such that the driving transistor 14 operates in a saturation region. If the driving transistor 14 and the converting transistor 102 have the same mobility and threshold, the current Idriv supplied to the light emitting element 15 is determined by the signal current Idata and the ratio between the channel width and the channel length of each of the driving transistor 14 and the converting transistor 102. In such a case, the current Idriv supplied to the light emitting element 15 is represented by the following formula (1) where L1 and W1 are the channel length and the channel width of the driving transistor 14 respectively, and L2 and W2 are the channel length and the channel width of the converting transistor 102 respectively.

$$Idriv=(W1/L1)/(W2/L2)\times Idata \quad (1)$$

In this manner, even when there are variations in characteristics of transistors between pixels, if the adjacent transistors (the driving transistor 14 and the converting transistor 102) have no variations in characteristics such as mobility and threshold, a current supplied to the light emitting element in each pixel depends exclusively on a signal current Idata supplied from the current source 106, which results in high quality display without variations in luminance.

During a non-lighting period shown in FIG. 9C, the driving transistor 14 is turned off. If the driving transistor 14 has an off current at this time, the off current flows through the light emitting element 15. In order to prevent the off current from being supplied to the light emitting element 15, the off current of the driving transistor 14 flows through the pass element 16 that satisfies R (off)>Rp>>R (on), and more preferably R (off)>>Rp>>R (on). When R (off)>>Rp>>R (on) is satisfied, most of the off current of the driving transistor 14 can flow through the pass element 16. As a result, high quality black display can be achieved.

Note that in the pixel circuit shown in FIG. 8, a reverse bias voltage may be applied to the light emitting element 15. In general, no current flows through the light emitting element 15 when a reverse bias voltage is applied thereto. However, if the light emitting element 15 has a short-circuited portion, a current concentrates on the short-circuited portion to burn it, thereby degradation of the light emitting element 15 can be reduced and reliability can be improved. Applying such a reverse bias voltage can burn a progressive short-circuited portion as well as an initial short-circuited portion, which results in reduced degradation of the light emitting element 15 and increased reliability.

According to the pixel structure shown in this embodiment mode, the pass element prevents the off current of the driving transistor from flowing through the light emitting element in a non-lighting period, leading to high quality black display. In addition, the pixel structure shown in this embodiment mode can provide a highly reliable display device that can maintain high image quality regardless of variations in transistors. Note that, the driving transistor may have a double gate structure or an LDD structure if desired.

Embodiment Mode 8

Described in this embodiment mode is a cross sectional structure of the pixels shown in the aforementioned embodiment modes.

Figure 12A:
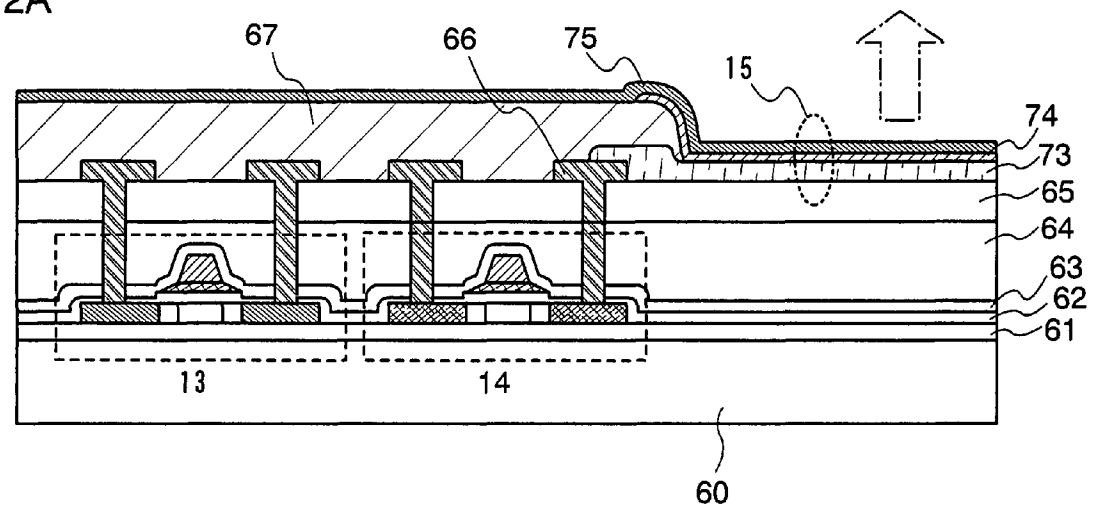
FIGS. 12A and 12B are cross sectional views of a pixel of the invention.
Figure 12B:
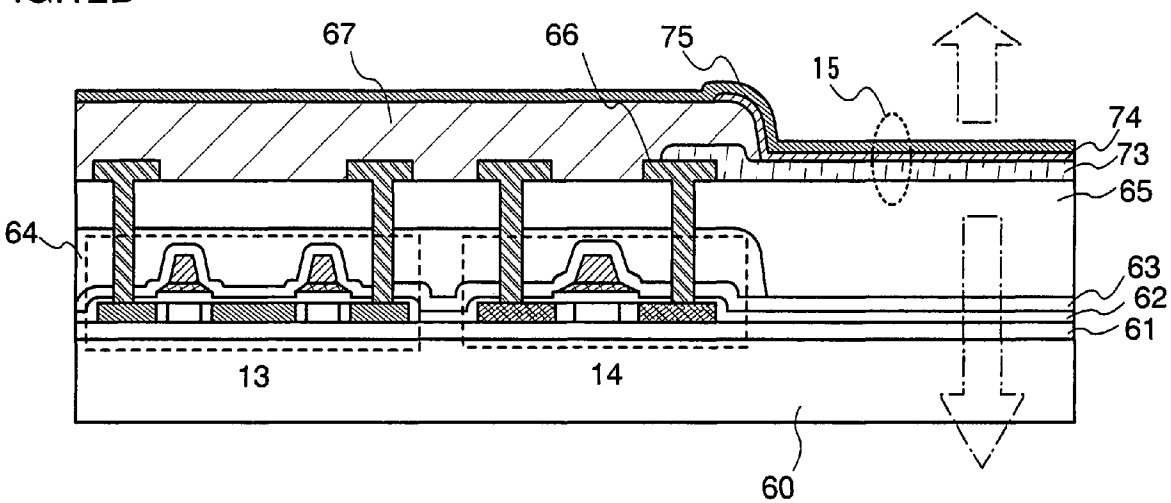

FIGS. 12A and 12B are cross sectional views each showing a switching element 13, a driving transistor 14, and a light emitting element 15. Over a base insulating film 61 formed over an insulating substrate 60, thin film transistors are provided as the switching transistor 13 and the driving transistor 14. In this embodiment mode, a P-channel transistor is used as the thin film transistor 13 and an N-channel transistor is used as the thin film transistor 14.

The insulating substrate 60 may be a glass substrate such as barium borosilicate glass and alumino borosilicate glass, a quartz substrate, or the like. As another substrate having an insulating surface, there is a flexible substrate made of a synthetic resin such as plastic typified by polyethylene terephthalate (PET), polyethylene naphthalate (PEN), and polyethersulfone (PES), and acrylic.

The thin film transistors 13 and 14 each has a semiconductor film to be an active layer, and a gate insulating film 62 and a gate electrode that are provided over the semiconductor film.

The semiconductor film may be any of an amorphous semiconductor, an SAS having both an amorphous state and a crystalline state, a microcrystalline semiconductor where crystal grains of 0.5 to 20 nm size are observed in an amorphous semiconductor, and a crystalline semiconductor.

In this embodiment mode, a crystalline semiconductor film obtained by crystallizing an amorphous semiconductor film by heat treatment is used. The heat treatment may be performed by a furnace, laser irradiation, irradiation of light emitted from a lamp instead of laser light (hereinafter referred to as lamp annealing), or a combination thereof.

If laser irradiation is adopted, a continuous wave laser beam (CW laser beam) or a pulsed laser beam (pulse laser beam) can be used. As the laser beam, one or more of an Ar laser, a Kr laser, an excimer laser, a YAG laser, a $Y_2O_3$ laser, a $YVO_4$ laser, a YLF laser, a $YAlO_3$ laser, a glass laser, a ruby laser, an alexandrite laser, a Ti:sapphire laser, a copper vapor laser, and a gold vapor laser can be used. It is possible to obtain crystals with a large grain size when a fundamental wave of such laser beams or second to fourth harmonics of the fundamental wave are used. For example, it is possible to use the second harmonic (532 nm) or the third harmonic (355 nm) of an Nd:$YVO_4$ laser (fundamental wave: 1064 nm). At this time, an energy density of about 0.01 to 100 MW/cm$^2$ (preferably 0.1 to 10 MW/cm$^2$) is required. The laser light is irradiated at a scan rate of about 10 to 2000 cm/sec.

A continuous wave laser beam of a fundamental wave and a continuous wave laser beam of a harmonic may be irradiated, or a continuous wave laser beam of a fundamental wave and a pulsed laser beam of a harmonic may also be irradiated. A plurality of laser beams can compensate energy.

When a pulsed laser beam is adopted, the pulsed laser beam may be irradiated with such an irradiation frequency that a semiconductor film melted by a laser is irradiated with the next pulse laser before being solidified. According to a laser beam with such a frequency, crystal grains that are sequentially grown in the scan direction can be obtained. More specifically, a laser beam with an oscillation frequency of 10 MHz or more may be used, which is a much higher frequency than that of tens to hundreds of Hz of a normally used laser beam.

The laser irradiation may be performed in an inert gas atmosphere such as a noble gas and nitrogen. According to this, roughness of a semiconductor surface due to laser irradiation can be suppressed to increase the uniformity, which prevents variations in threshold caused by variations in interface state density.

Alternatively, a microcrystalline semiconductor film may be formed by utilizing $SiH_4$ and $F_2$ or $SiH_4$ and $H_2$, and then crystallized by the aforementioned laser irradiation.

When a furnace is used as another heat treatment, the amorphous semiconductor film is heated at a temperature of 500 to 550° C. for 2 to 20 hours. The temperature at this time is preferably set in multiple stages within a range of 500 to 550° C. so as to increase gradually. At the first low temperature heating step, hydrogen and the like of the amorphous semiconductor film are exhausted, thereby a so-called hydrogen exhaust can be performed to suppress the roughness of the film in crystallization. Further, when a metal element that accelerates crystallization, for example nickel (Ni), is formed over the amorphous semiconductor film, heating temperature can be lowered. Even in the crystallization using such a metal element, the film may be heated at a temperature of 600 to 950° C.

If a metal element is formed, however, it may adversely affect electrical characteristics of a semiconductor element, thus, the metal element is required to be reduced or removed by gettering. As a gettering step, for example, the metal element may be captured using the amorphous semiconductor film as a gettering sink.

Alternatively, a crystalline semiconductor film may be formed directly over the base insulating film. In that case, the crystalline semiconductor film can be formed directly by utilizing heat or plasma with the use of fluorine gas such as $GeF_4$ and $F_2$ and silane gas such as $SiH_4$ and $Si_2H_6$.

When a high temperature treatment is required in such a manufacturing method of a semiconductor film, a high heat resistant quartz substrate may preferably be employed.

A gate insulating film and a gate electrode are sequentially formed over the thus formed semiconductor film. The gate insulating film may be made of an oxide film containing silicon or a nitride film containing silicon.

Subsequently, an impurity element is doped in a self aligned manner using the gate electrode as a mask, thereby a source region and a drain region that are doped with the impurity element, and a channel forming region under the gate electrode are formed. At this time, the end of the gate electrode is formed to be tapered shape to form a low concentration impurity region (LDD region). A structure having a low concentration impurity region is called an LDD (Lightly Doped Drain) structure. According to the LDD structure, resistance to hot carrier degradation can be enhanced and off leak current can be reduced. If a portion of the low concentration impurity region overlaps the gate electrode, such a structure is called a gate overlap LDD structure (GOLD structure). The GOLD structure has high current driving capability and significantly enhanced resistance to hot carrier degradation. The LDD structure or the GOLD structure can be obtained, for example, when the gate electrode has a stacked structure and the first gate electrode and the second gate electrode have different tapered shapes. Such a gate electrode is preferably formed by stacking in this order tantalum nitride (TaN) and tungsten (W), tantalum nitride (TaN) and titanium (Ti), tantalum nitride (TaN) and aluminum (Al), or tantalum nitride (TaN) and copper (Cu), as the first and second gate electrodes respectively. Alternatively, the first and second gate electrodes may be formed using a semiconductor film typified by a polycrystalline silicon film doped with an impurity element such as phosphorous (P), or an AgPdCu alloy. Further, in order to prevent the short-channel effect that may occur with the miniaturization of the channel forming region, a so-called side wall structure is preferably adopted, where insulators are formed on the sides of the gate electrode and a low concentration impurity region is formed under the insulators.

Then, an opening is formed in the gate insulating film and wirings connected to the source region and the drain region (referred to as a source wiring and a drain wiring respectively) are formed, thereby a thin film transistor is completed.

In this embodiment mode, however, a passivation film 63 is further formed so as to cover the gate electrode and the semiconductor film. The passivation film 63 prevents oxidization of the surface of the gate electrode. In addition, hydrogen contained in the passivation film 63 allows defects (dangling bond) of the semiconductor film to be terminated. The passivation film 63 may be formed of an oxide film containing silicon or a nitride film containing silicon, and specifically, silicon oxide ($SiO_x$), silicon nitride ($SiN_x$), silicon oxynitride ($SiO_xN_y$) (x>y), silicon nitride oxide ($SiN_xO_y$) (x>y) (x, y=1, 2, . . . ), and the like. Further, in this embodiment mode, an interlayer insulating film is provided to improve the uniformity. The interlayer insulating film may be formed of an organic material or an inorganic material. As the organic material, polyimide, acrylic, polyamide, polyimide-amide, resist materials, benzocyclobutene, siloxane, and polysilazane can be used. Siloxane is composed of a skeleton formed by the bond of silicon (Si) and oxygen (O), in which an organic group containing at least hydrogen (such as an alkyl group or aromatic hydrocarbon) is included as a substituent. Alternatively, a fluoro group may be used as the substituent. Further alternatively, a fluoro group and an organic group containing at least hydrogen may be used as the substituent. Polysilazane is formed from a liquid material containing a polymer material having the bond of silicon (Si) and nitrogen (N) as a starting material. The inorganic material includes an insulating film containing oxygen or nitrogen, such as silicon oxide ($SiO_x$), silicon nitride ($SiN_x$), silicon oxynitride ($SiO_xN_y$) (x>y), and silicon nitride oxide ($SiN_xO_y$) (x>y) (x, y=1, 2, . . . ). Alternatively, the interlayer insulating film may be formed by stacking these insulating films. For example, if an organic material is used for the interlayer insulating film, uniformity is increased while moisture and oxygen are easily absorbed. In order to prevent this, an insulating film containing an inorganic material may be formed on the organic material. If an insulating film containing nitrogen is used as the inorganic material, alkali ions such as Na as well as moisture can be prevented from entering. In this embodiment mode, a first interlayer insulating film 64 is made of a colored organic material and a second interlayer insulating film 65 is made of a light emitting organic material. Note that a colored material can be obtained by dispersing particles such as carbon black into an organic material. The colored organic material prevents glare of light due to wirings and the like, and can function as a so-called black matrix.

Subsequently, an opening is formed in the first and second interlayer insulating films 64 and 65, the passivation film 63, and the gate insulating film 62, and a source/drain wiring 66 is formed. The source/drain wiring 66 is made of a single layer or stacked layers using a conductive material. For example, a stacked structure of titanium (Ti), aluminum silicon (Al—Si), and titanium (Ti), Mo, Al—Si, and Mo, or MoN, Al—Si, and MoN may be adopted. As a conductive material, an aluminum alloy (referred to as Al (C+Ni)) film containing carbon and nickel (1 to 20 wt %) may be used. The Al (C+Ni)) film has high heat resistance even after energization or heat treatment, and has an oxidation-reduction potential close to that of a pixel electrode (ITO or ITSO) shown below. Accordingly, in the Al (C+Ni)) film, electrical corrosion due to the battery effect does not occur easily and there are few variations in contact resistance values.

Then, a pixel electrode 73 is formed over the source/drain wiring 66 connected to the thin film transistors 13 and 14. The pixel electrode 73 is formed of a material that transmits light or no light. As a material that transmits light, ITO (Indium Tin Oxide), IZO (Indium Zinc Oxide) obtained by mixing 2 to 20% of zinc oxide (ZnO) into indium oxide, ITO-SiO. (referred to as ITSO for convenience) obtained by mixing 2 to 20% of silicon oxide ($SiO_2$) into indium oxide, organic indium, organotin, and the like may be employed. As a material that transmits no light, silver (Ag) as well as an element selected from tantalum, tungsten, titanium, molybdenum, aluminum, and copper, or an alloy material or a compound material mainly containing these elements may be employed.

An insulating film 67 is formed so as to cover the end of the pixel electrode 73. The insulating film 67 functions as a partition wall (bank) when forming an electroluminescent layer. Similarly to the interlayer insulating film, the insulating film 67 may be formed of either an inorganic material or an organic material.

Next, an opening is formed in the insulating film 67 and an electroluminescent layer 74 is formed in the opening. Since the electroluminescent layer 74 is formed so as to be in contact with the insulating film 67 at this time, it is desirable that the insulating film 67 have a shape with a curvature radius changing continuously such that pinholes and the like are not formed in the electroluminescent layer 74. In addition, the steps from heat treatment of the insulating film 67 to the formation of the electroluminescent layer 74 are desirably performed in sequence without exposing to the atmosphere.

The electroluminescent layer 74 may be formed of an organic material (including a low molecular weight material and a high molecular weight material), or a composite material of an organic material and an inorganic material. The electroluminescent layer 74 may be formed by droplet discharging, coating using a liquid, or vapor deposition. A high molecular weight material is preferably formed by droplet discharging or coating using a liquid, and a low molecular weight material is preferably formed by vapor deposition, and particularly vacuum deposition. In this embodiment mode, the electroluminescent layer 74 is formed by vacuum deposition using a low molecular weight material.

Molecular exciton state of the electroluminescent layer 74 may be either an excited singlet state or an excited triplet state. A ground state is generally an excited singlet state. The luminescence in the electroluminescent layer includes luminescence generated from an excited singlet state (fluorescence) and luminescence generated from an excited triplet state (phosphorescence). Fluorescence and phosphorescence may be combined and either of them may be selected for each RGB depending on light emission characteristics (luminance, life and the like) thereof. For example, an electroluminescent layer for R is made of a material in an excited triplet state and electroluminescent layers for G and B are made of a material in an excited singlet state.

Specifically, the electroluminescent layer 74 has a stacked structure where an HIL (Hole Injection Layer), an HTL (Hole Transporting Layer), an EML (Emitting Layer), an ETL (Electron Transporting Layer), and an EIL (Electron Injection Layer) are stacked in this order over the pixel electrode 73. Note that the electroluminescent layer 74 may have a single layer structure and a composite structure as well as a stacked structure.

More specifically, CuPc or PEDOT is used as the HIL, α-NPD is used as the HTL, BCP or $Alq_3$ is used as the ETL, and BCP:Li or $CaF_2$ is used as the EIL. The EML may be formed of $Alq_3$ doped with a dopant corresponding to each emission color of R, G and B (DCM or the like for R, DMQD or the like for G).

The materials of the electroluminescent layer 74 are not limited to the aforementioned. For example, oxide such as molybdenum oxide ($MoO_x$:x=2 to 3), and α-NPD or rubrene may be co-deposited instead of CuPc and PEDOT, thereby hole injection properties are improved. Alternatively, a benzoxazole derivative (referred to as BzOS) may be used for the electron injection layer.

Further, electroluminescent layers for RGB may be formed using color filters to achieve high definition display. The color filters allow the broad peak of the emission spectrum for each RGB to be sharpened.

Although the electroluminescent layers for RGB are formed above, electroluminescent layers emitting light of a single color may be used as well. In such a case, full color display can be performed by combining a color filter and a color conversion layer. For example, when an electroluminescent layer emitting white or orange light is formed, full color display can be performed by providing a color filter or a color filter combined with a color conversion layer.

It is needless to say that monochrome display may be performed by forming an electroluminescent layer emitting monochrome light. For example, area color display can be performed using monochrome light, which is suitable for displaying letters and symbols.

Subsequently, a second electrode 75 of the light emitting element 15 is formed so as to cover the electroluminescent layer 74 and the insulating film 67.

The materials of the pixel electrode (referred to as a first electrode for convenience) 73 and the second electrode 75 are required to be determined taking work function into consideration. The first electrode 73 and the second electrode 75 may be either an anode or a cathode depending on the pixel structure. The electrode materials of the anode and the cathode are described below.

The anode is preferably formed using a metal, an alloy, a conductive compound, and a mixture thereof, each of which has a high work function (work function of 4.0 eV or more). More specifically, it is possible to use ITO, ZnO, IZO, ITSO, gold, platinum, nickel, tungsten, chromium, molybdenum, iron, cobalt, copper, palladium, nitride of a metal material (e.g., titanium nitride), and the like.

The cathode is preferably formed using a metal, an alloy, a conductive compound, and a mixture thereof, each of which has a low work function (work function of 3.8 eV or less). More specifically, it is possible to use an element belonging to Group 1 or Group 2 of the periodic table, namely an alkaline metal such as lithium and cesium; magnesium, calcium, strontium, an alloy (Mg:Ag, Al:Li) or a compound (LiF, CsF, $CaF_2$) containing them, and a transition metal including a rare earth metal.

The light emitting direction from the electroluminescent layer 74 can be selected depending on whether the first electrode 73 and the second electrode 75 transmit light or no light. For example, when both the first electrode 73 and the second electrode 75 are formed of a material that transmits light, light from the electroluminescent layer 74 can be emitted in both directions of the substrate 60 and a sealing substrate (dual emission).

When light from the electroluminescent layer 74 is emitted in the direction of the substrate 60, the first electrode 73 may be formed of a material that transmits light while the second electrode 75 may be formed of a material that transmits no light. As a result, a bottom emission display device can be obtained. When light from the electroluminescent layer 74 is emitted in the direction of the sealing substrate, the first electrode 73 may be formed of a material that transmits no light while the second electrode 75 may be formed of a material that transmits light. As a result, a top emission display device can be obtained. The electrode transmitting no light that is provided at the opposite side of the light emitting direction may be formed of a conductive film with high reflectivity, thereby light can be used effectively.

In this embodiment mode, a colored organic material can be used for the first interlayer insulating film 64, which can be used as black matrix. Further, the first electrode 73 is formed of a material that transmits no light while the second electrode 75 is formed of a light transparent material such as ITO, thereby a top emission display device is obtained. If a colored organic material is not used for the first interlayer insulating film 64 and a transparent material such as ITO is used for the first electrode 73, a bottom emission display device can be obtained.

If either the first electrode 73 or the second electrode 75 is required to transmit light in this embodiment mode, a quite thin film of a metal or an alloy containing the metal may be used. Alternatively, a transparent conductive film such as ITO, IZO, and ITSO or other transparent conductive film (including alloys) may be stacked over the thin metal.

The pixel portion can be formed in this manner.

In order to prevent the cross talk between the signal line and the scan line, the interlayer insulating film is preferably increased in thickness. At this time, an organic material may be used for a portion of the interlayer insulating film to obtain a thickness that can prevent cross talk, and further, a stacked structure may be adopted as well. If an inorganic material is used for the interlayer insulating film, a low dielectric constant material (low-k material) is preferably used.

When interlayer insulating films are stacked and light from the light emitting element is emitted below, it is preferable to prevent light refraction at an interface between dissimilar materials. For example, an opening is formed in the first interlayer insulating film and the second interlayer insulating film is formed so as to bury the opening. As a result, light refraction at an interface between the first interlayer insulating film and the second interlayer insulating film can be prevented, leading to increased light extraction efficiency.

FIG. 12B shows a structure example of such stacked interlayer insulating films.

FIG. 12B is different from FIG. 12A in that interlayer insulating films are stacked and the first interlayer insulating film has an opening. The opening is provided in an area where the electroluminescent layer 74 is formed. The switching element 13 is formed using a thin film transistor having a multi-gate structure where a plurality of gate electrodes are formed over the semiconductor film. Other structures are similar to those shown in FIG. 12A, therefore, the description thereof is omitted. Accordingly, even when a colored organic material is used for the first interlayer insulating film, a bottom emission display device can be obtained. Further, even when a colored organic material is not used, light refraction at an interface between interlayer insulating films and the like can be reduced by forming the opening in the first interlayer insulating film.

Similarly to the structure shown in FIG. 12A, a dual emission display device can be obtained when both the first electrode and the second electrode are formed of a material that transmits light. Needless to say, when the first electrode is formed of a material that transmits no light while the second electrode is formed of a material that transmits light, a top emission display device can be obtained.

Figure 13A:
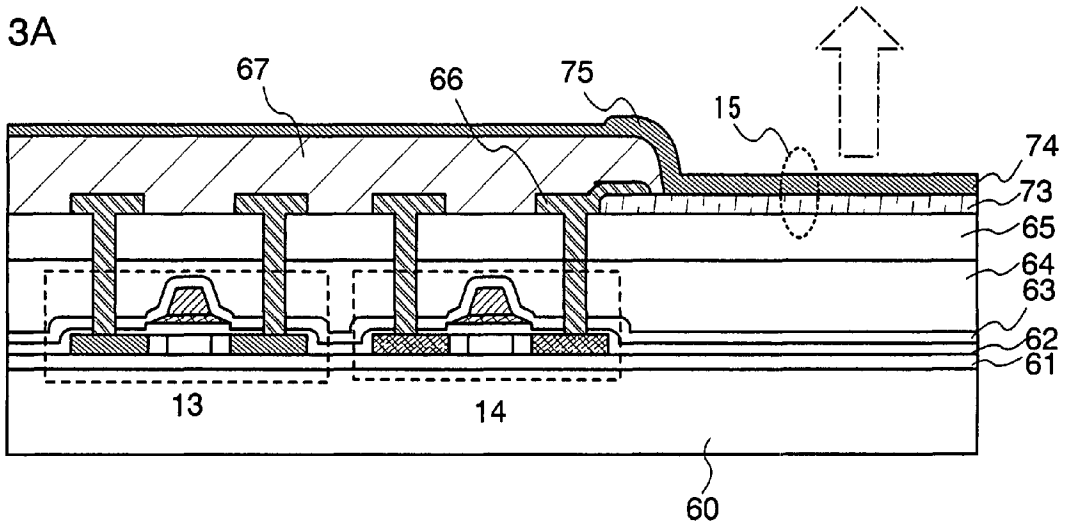
FIGS. 13A and 13B are cross sectional views of a pixel of the invention.

FIG. 13A is different from FIG. 12A in that the wiring 66 is formed after the formation of the pixel electrode 73. Other structures are similar to those shown in FIG. 12A, therefore, the description thereof is omitted.

Figure 13B:
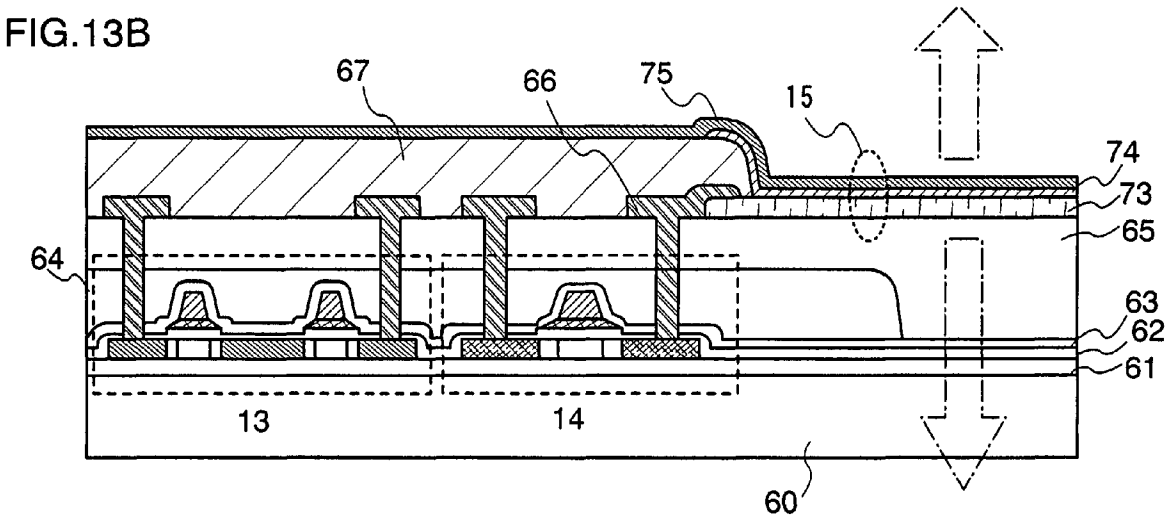

FIG. 13B is different from FIG. 13A in that an opening is formed in the first interlayer insulating film. The opening in the first interlayer insulating film is formed in an area where the electroluminescent layer 74 is formed. The switching element 13 is formed using a thin film transistor having a multi-gate structure where a plurality of gate electrodes are formed over the semiconductor film. Other structures are similar to those shown in FIG. 13A, therefore, the structure shown in FIG. 12A can be referred to. Accordingly, even when a colored organic material is used for the first interlayer insulating film, a bottom emission display device can be obtained. Further, even when a colored organic material is not used, light refraction at an interface between the interlayer insulating films and the like can be reduced by forming the opening in the first interlayer insulating film.

Similarly to the structure shown in FIG. 12A, a dual emission display device can be obtained as shown in FIG. 13B when both the first electrode and the second electrode are formed of a material that transmits light. Needless to say, when the first electrode is formed of a material that transmits no light while the second electrode is formed of a material that transmits light, a top emission display device can be obtained.

Figure 14A:
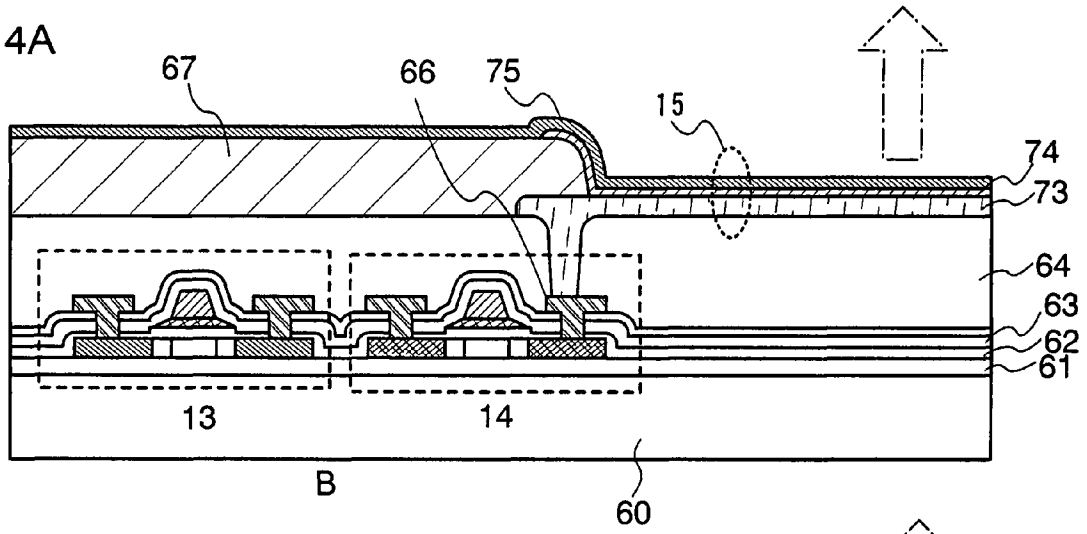
FIGS. 14A and 14B are cross sectional views of a pixel of the invention.

FIG. 14A is different from FIG. 12A in that the passivation film has a stacked structure, the wiring 66 is formed before the formation of the interlayer insulating film, an opening is formed in the interlayer insulating film 64, and the pixel electrode 73 is formed so as to be connected to the wiring 66. As the passivation film, a silicon oxynitride (SiNO) film and a silicon nitride oxide (SiON) film may be stacked in this order. In the pixel shown in FIG. 14A, the first interlayer insulating film 64 and the second interlayer insulating film 65 may be stacked. Other structures are similar to those shown in FIG. 12A, therefore, the description thereof is omitted.

Figure 14B:
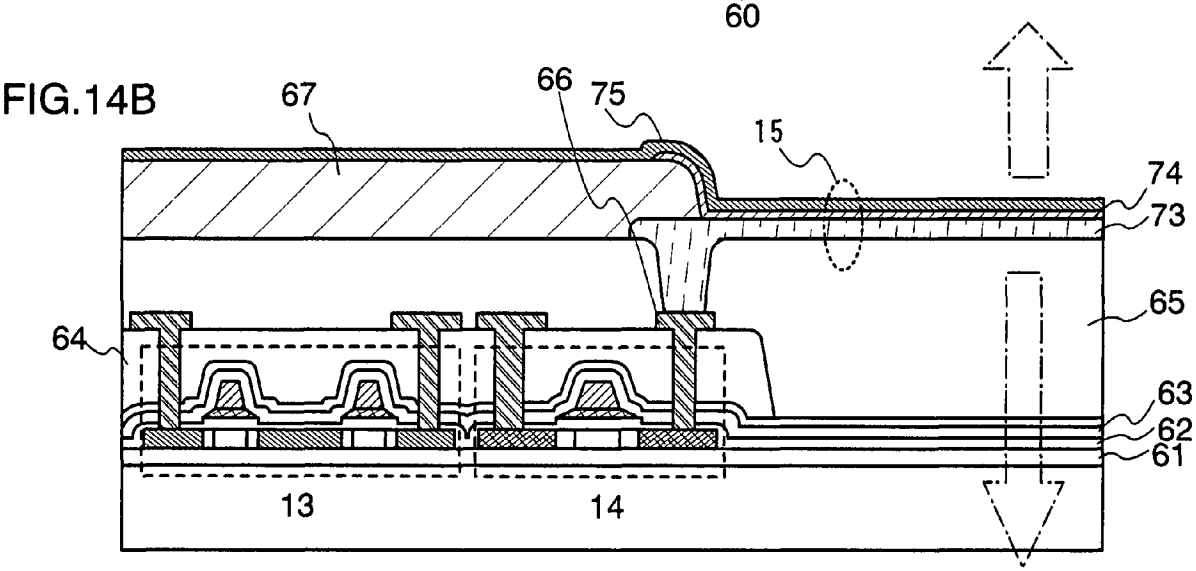

FIG. 14B is different from FIG. 14A in that an opening is formed in the first interlayer insulating film. The opening in the first interlayer insulating film is formed in an area where the electroluminescent layer 74 is formed. The switching element 13 is formed using a thin film transistor having a multi-gate structure where a plurality of gate electrodes are formed over the semiconductor film. Other structures are similar to those shown in FIG. 14A, therefore, the structure shown in FIG. 12A can be referred to. Accordingly, even when a colored organic material is used for the first interlayer insulating film, a bottom emission display device can be obtained. Further, even when a colored organic material is not used, light refraction at an interface between interlayer insulating films and the like can be reduced by forming the opening in the first interlayer insulating film.

Similarly to the structure shown in FIG. 12A, a dual emission display device can be obtained as shown in FIG. 14B when both the first electrode and the second electrode are formed of a material that transmits light. Needless to say, when the first electrode is formed of a material that transmits no light while the second electrode is formed of a material that transmits light, a top emission display device can be obtained.

Figure 15A:
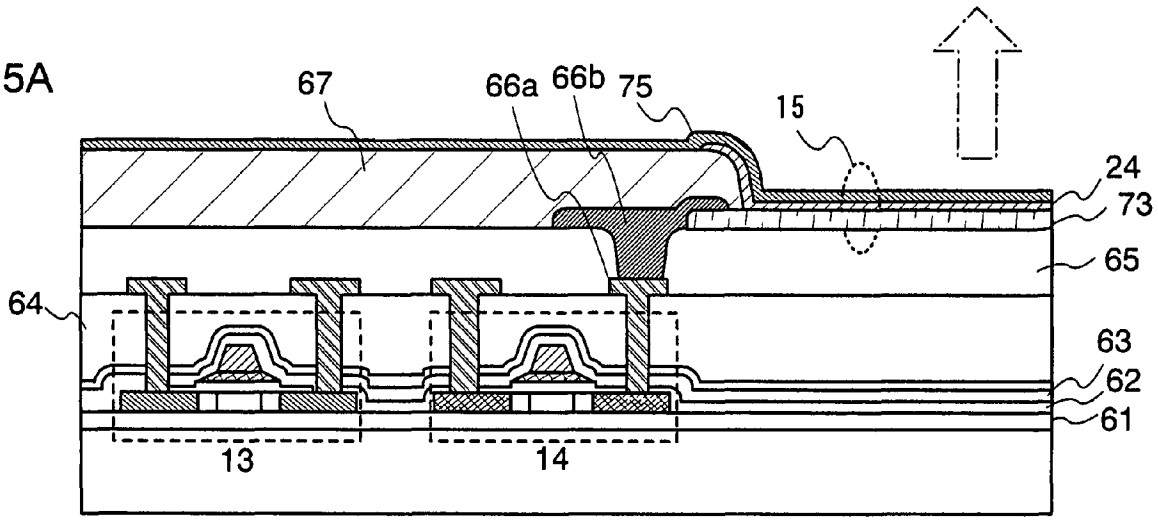
FIGS. 15A and 15B are cross sectional views of a pixel of the invention.

FIG. 15A is different from FIG. 12A in that the wiring 66 includes two layers. That is, an opening is formed in the first interlayer insulating 64 to form a wiring 66*a*, then the second interlayer insulating film 65 is formed and an opening is formed therein to form a wiring 66*b*. For example, Al (C+Ni) may be used for the wiring 66*a* and a stacked layer of Ti, Al—Si and Ti may be used for the wiring 66*b*. Other structures are similar to those shown in FIG. 14A, therefore the structure shown in FIG. 12A can be referred to.

Figure 15B:
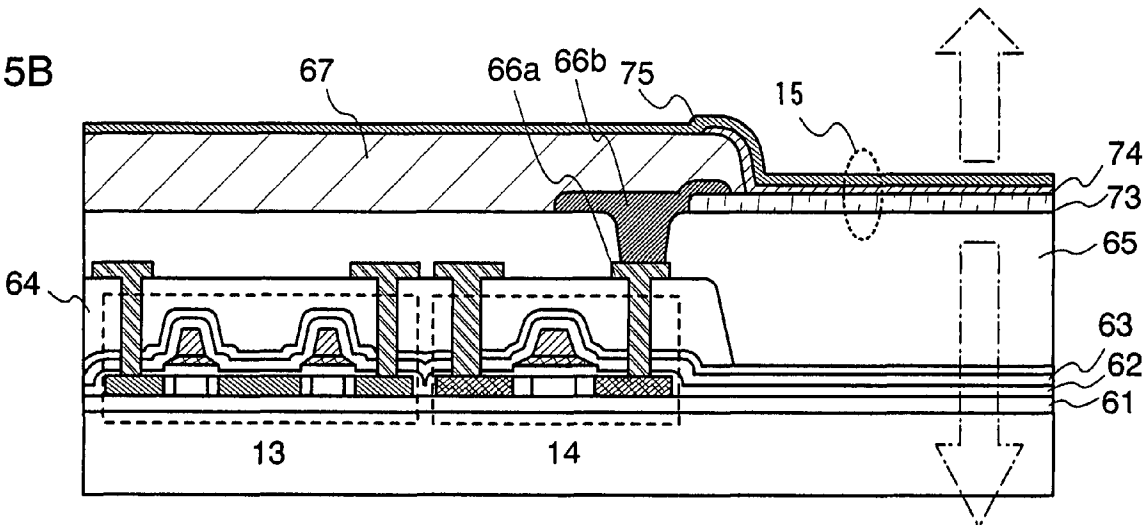

FIG. 15B is different from FIG. 15A in that an opening is formed in the first interlayer insulating film. The opening in the first interlayer insulating film is formed in an area where the electroluminescent layer 74 is formed. The switching element 13 is formed using a thin film transistor having a multi-gate structure where a plurality of gate electrodes are formed over the semiconductor film. Other structures are similar to those shown in FIG. 15A, therefore, the structure shown in FIG. 12A can be referred to. Accordingly, even when a colored organic material is used for the first interlayer insulating film, a bottom emission display device can be obtained. Further, even when a colored organic material is not used, light refraction at an interface between the interlayer insulating films and the like can be reduced by forming the opening in the first interlayer insulating film. In addition, when both the first electrode and the second electrode are formed of a material that transmits light, a dual emission display device can be obtained as shown in FIG. 15B. Needless to say, a top emission display device can also be obtained when the first electrode is formed of a material that transmits no light while the second electrode is formed of a material that transmits light.

When the pixel electrode 73 is thus formed over a plane surface such as the interlayer insulating film, voltage can be applied uniformly, which results in high quality image display.

The thus formed display device may be provided with a polarizer or a circular polarizer to increase contrast. In this case, a film (polarizing film) having the wavelength of the light emitting element as a center wavelength and polarizing the wavelength range may be provided at the emitting side of the light emitting element, thereby contrast can be increased and glare due to wirings and the like can be prevented.

A driver circuit portion such as a signal line driver circuit and a scan line driver circuit may be formed over the same substrate as the aforementioned pixel portion. In such a case, a polycrystalline silicon film is preferably used for the semiconductor film.

Figure 16:
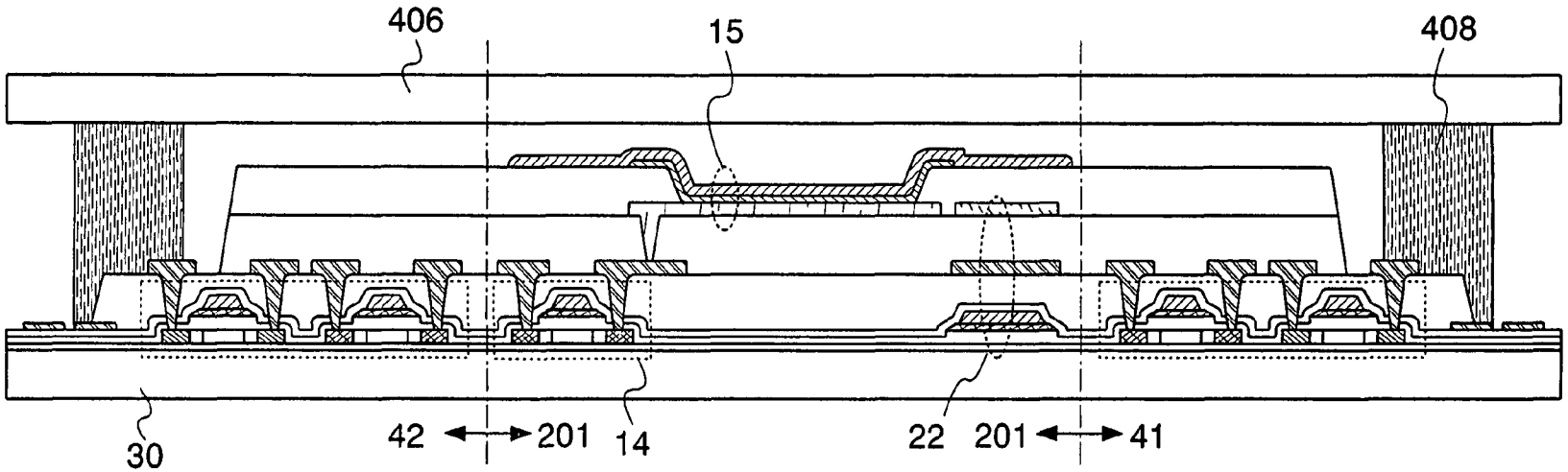
FIG. 16 is a cross sectional view of a display device of the invention.

FIG. 16 is a cross sectional view of the pixel portion, the first gate driver 41, and the second gate driver 42 that are shown in FIG. 10. Although not shown in FIGS. 14A and 14B, the capacitor 22 is formed of the material of the gate electrode, the insulating material of the interlayer insulating film 64 and the like, and the wiring 66. A sealing member 408 is provided over a portion of the first and second gate drivers 41 and 42. A counter substrate 406 can be attached with the sealing member 408. The space formed by attaching the counter substrate 406 may be filled with an inert gas such as nitrogen, a resin material, or a drying agent. According to this, degradation of the light emitting element 15 due to moisture and oxygen can be prevented.

When the sealing member 408 is provided over the gate drivers 41 and 42 as shown in FIG. 16, a narrower frame of the display device can be achieved. The sealing member 408 may also be provided over the source driver. In this case, however, it is necessary to pay attention to a lot of lead wirings and the like.

Such a sealing structure can be applied to any of the pixel structures shown in FIGS. 12A and 12B, FIGS. 13A and 13B, FIGS. 14A and 14B, and FIGS. 15A and 15B.

This embodiment mode can be freely combined with other embodiment modes.

Embodiment Mode 9

A display device having a pixel area including a light emitting element can be applied to various electronic apparatuses such as a television set (television, television receiver), a digital camera, a digital video camera, a mobile phone set (mobile phone), a portable information terminal such as a PDA, a portable game machine, a monitor, a computer, an audio reproducing device such as an in-car audio system, and an image reproducing device provided with a recording medium such a home game machine. Specific examples of them are described with reference to FIGS. 19A to 19F.

Figure 19A:
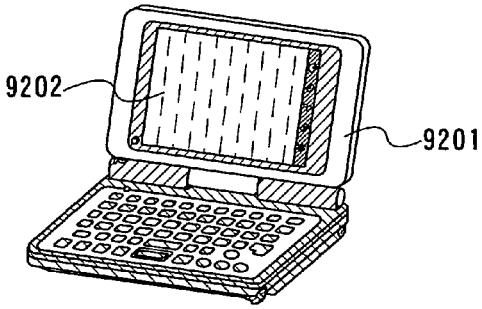
FIGS. 19A to 19F are views each showing an electronic apparatus using the invention.
Figure 19B:
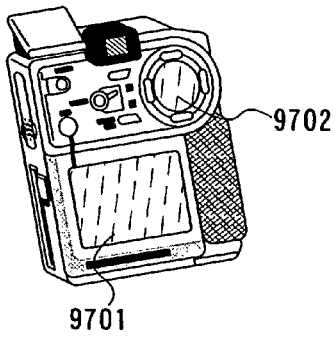
Figure 19C:
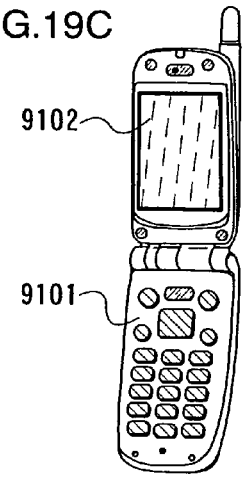
Figure 19D:
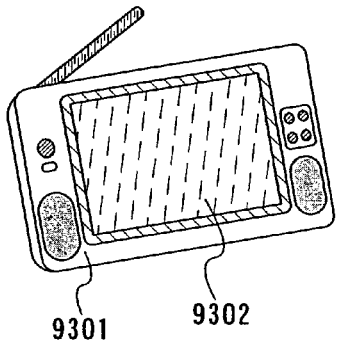
Figure 19E:
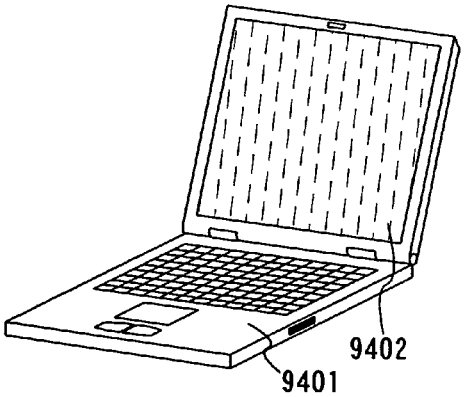
Figure 19F:
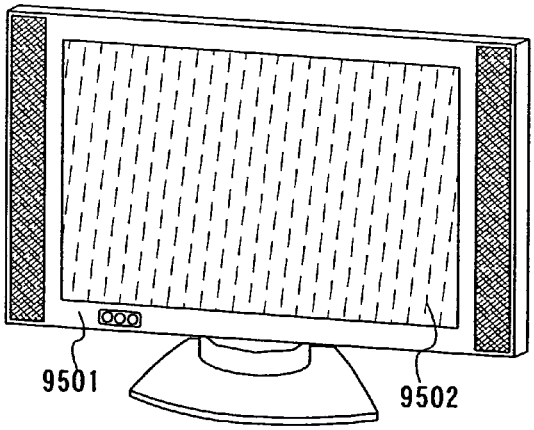

FIG. 19A shows a portable information terminal using the display device of the invention, which includes a main body 9201, a display portion 9202, and the like. According to the invention, low power consumption can be achieved. FIG. 19B shows a digital video camera using the display device of the invention, which includes display portions 9701 and 9702, and the like. According to the invention, low power consumption can be achieved. FIG. 19C shows a portable terminal using the display device of the invention, which includes a main body 9101, a display portion 9102, and the like. According to the invention, low power consumption can be achieved. FIG. 19D shows a portable television set using the display device of the invention, which includes a main body 9301, a display portion 9302, and the like. According to the invention, low power consumption can be achieved. FIG. 19E shows a portable computer using the display device of the invention, which includes a main body 9401, a display portion 9402, and the like. According to the invention, low power consumption can be achieved. FIG. 19F shows a television set using the display device of the invention, which includes a main body 9501, a display portion 9502, and the like. According to the invention, low power consumption can be achieved. If the aforementioned electronic apparatuses use a battery, they can last a long time because of the reduced power consumption, and battery charge can be saved.

This application is based on Japanese Patent Application serial No. 2004-152543 filed in Japan Patent Office on May 21, 2004, the contents of which are hereby incorporated by reference.

What is claimed is:

1. A display device comprising a light emitting element, a first transistor, a second transistor, and a third transistor, wherein a first electrode of the light emitting element is directly connected to one of a source and a drain of the first transistor, wherein one of a source and a drain of the second transistor is directly connected to the first electrode of the light emitting element, wherein the other of the source and the drain of the second transistor is directly connected to a second electrode of the light emitting element, wherein a gate of the second transistor is directly connected to a power supply line, wherein the other of the source and the drain of the first transistor is directly connected to one of a source and a drain of the third transistor, wherein the other of the source and the drain of the third transistor is electrically connected to the power supply line, and wherein the second transistor is configured to meet a requirement that resistance of the second transistor is larger than resistance of the light emitting element when the light emitting element emits light and that the resistance of the second transistor is smaller than the resistance of the light emitting element when the light emitting element emits no light such that an off current of the first transistor flows in the second transistor.

2. The display device according to claim 1, the display device further comprising a switching element electrically connected to the third transistor, wherein the switching element is selected by a scan line; and a video signal is inputted from a signal line to the switching element when the switching element is selected.

3. The display device according to claim 1, wherein a gate of the first transistor has a constant potential.

4. The display device according to claim 1, the display device further comprising a capacitor that is provided between a gate of the third transistor and the other of the source and the drain of the third transistor.

5. A display device comprising a light emitting element, a first transistor, a second transistor, and a third transistor, wherein a first electrode of the light emitting element is directly connected to one of a source and a drain of the first transistor, wherein one of a source and a drain of the second transistor is directly connected to the first electrode of the light emitting element, wherein the other of the source and the drain of the second transistor is directly connected to a second electrode of the light emitting element, wherein a gate of the second transistor is directly connected to a power supply line, wherein the other of the source and the drain of the first transistor is electrically connected to one of a source and a drain of the third transistor, wherein the other of the source and the drain of the third transistor is directly connected to the power supply line, wherein the gate of the first transistor and the gate of the third transistor are electrically connected to each other, and wherein the second transistor is configured to meet a requirement that resistance of the second transistor is larger than resistance of the light emitting element when the light emitting element emits light and that the resistance of the second transistor is smaller than the resistance of the light emitting element when the light emitting element emits no light such that an off current of the first transistor flows in the second transistor.

6. The display device according to claim 5, the display device further comprising a switching element electrically connected to the third transistor, wherein the switching element is selected by a scan line, and a video signal is inputted from a signal line to the switching element when the switching element is selected.

7. The display device according to claim 5, the display device further comprising a capacitor that is provided between a gate of the third transistor and the other of the source and the drain of the third transistor.

* * * * *